US011280593B2

(12) United States Patent
Sitzman et al.

(10) Patent No.: US 11,280,593 B2
(45) Date of Patent: Mar. 22, 2022

(54) APPARATUS AND METHOD FOR INDICATING WHETHER A TARGET HAS BEEN IMPACTED BY A PROJECTILE

(71) Applicant: Nielsen-Kellerman Co., Boothwyn, PA (US)

(72) Inventors: Alex J. Sitzman, Austin, TX (US); Weston D. Petersen, Dripping Springs, CO (US); Garet L. Itz, Woodland Park, TX (US); Ivan Dorflinger, Austin, TX (US)

(73) Assignee: Nielsen-Kellerman Co., Boothwyn, PA (US)

( * ) Notice: Subject to any disclaimer, the term of this patent is extended or adjusted under 35 U.S.C. 154(b) by 0 days.

(21) Appl. No.: 16/787,413

(22) Filed: Feb. 11, 2020

(65) Prior Publication Data

US 2020/0173758 A1 Jun. 4, 2020

Related U.S. Application Data

(62) Division of application No. 15/872,237, filed on Jan. 16, 2018.

(60) Provisional application No. 62/446,122, filed on Jan. 13, 2017.

(51) Int. Cl.

| | |
|---|---|
| ***F41J 5/02*** | (2006.01) |
| ***F41J 5/14*** | (2006.01) |
| ***F41J 5/06*** | (2006.01) |
| ***F41J 5/24*** | (2006.01) |

(52) U.S. Cl.

CPC . *F41J 5/02* (2013.01); *F41J 5/06* (2013.01); *F41J 5/14* (2013.01); *F41J 5/24* (2013.01)

(58) Field of Classification Search

CPC . F41J 5/02; F41J 5/14; F41J 5/18; F41J 5/04; F41J 5/06; F41J 5/24

See application file for complete search history.

(56) References Cited

U.S. PATENT DOCUMENTS

| | | | | |
|---|---|---|---|---|
| 3,778,169 A * | 12/1973 | Adams | G01C 15/002 | 356/399 |
| 5,575,479 A * | 11/1996 | Ayres | F41J 9/165 | 273/363 |
| 8,915,118 B2 * | 12/2014 | Russell | G01P 1/127 | 73/12.01 |
| 9,004,490 B2 * | 4/2015 | Kazakov | F41J 5/14 | 273/372 |

(Continued)

FOREIGN PATENT DOCUMENTS

KR 20090077357 A * 7/2009

*Primary Examiner* — Steve Rowland
(74) *Attorney, Agent, or Firm* — Cozen O'Connor

(57) ABSTRACT

Apparatuses, systems and methods for indicating whether a target has been impacted by a projectile are disclosed. Embodiments may include a microcontroller, an impact sensor, and an impact indicator. Apparatus may include an acoustic sensor and a miss indicator. Acoustic information or impact information may be received by the sensors and sent to the microcontroller unit. A determination may be made regarding whether the target has been impacted. An indication of a hit or a miss may be made by the impact indicator based on the determination. A light redirection element, which may include a light pipe, may direct light from the impact indicator around the edge of a target to a viewer.

14 Claims, 25 Drawing Sheets

(56) References Cited

U.S. PATENT DOCUMENTS

| | | | | |
|---|---|---|---|---|
| 2008/0138024 | A1* | 6/2008 | Parker | G02B 5/045 385/130 |
| 2008/0282964 | A1* | 11/2008 | Bennett | B60Q 7/02 116/28 R |
| 2010/0180946 | A1* | 7/2010 | Gruhlke | H01L 31/0547 136/259 |
| 2014/0119033 | A1* | 5/2014 | Vasylyev | G02B 5/0236 362/327 |
| 2014/0151965 | A1* | 6/2014 | Garas | F41J 5/06 273/371 |
| 2015/0062963 | A1* | 3/2015 | Meir | G02F 1/133602 362/607 |
| 2015/0330607 | A1* | 11/2015 | Di Trapani | G02B 6/0061 362/608 |
| 2016/0284910 | A1* | 9/2016 | Bouchard | H01L 31/0547 |
| 2020/0209609 | A1* | 7/2020 | Clarke | H04N 13/305 |

* cited by examiner

APPARATUS AND METHOD FOR INDICATING WHETHER A TARGET HAS BEEN IMPACTED BY A PROJECTILE

CROSS-REFERENCE TO RELATED APPLICATIONS

This application is related to the following applications:

I. U.S. Provisional Patent Application Ser. No. 62/446,122, filed 13 Jan. 2017 (the "Parent Provisional"); and II. U.S. Non-Provisional patent application Ser. No. 15/872,237, filed 16 Jan. 2018 (the "Parent Non-Provisional"); collectively (the "Parent Applications").

The subject matter of the Parent Applications are expressly incorporated herein by reference in their entireties.

FIELD OF THE INVENTION

The present disclosure relates to shooting sports. More particularly, the disclosure relates to target hit indicators. Even more specifically, the present disclosure relates to unitary target-mounted target hit indicators.

BACKGROUND

Shooting targets are commonly used for recreation or in competition and are often made of metal so that the target can withstand the impact of multiple bullets. When metallic targets are shot at close range, the sound of the bullet hitting the target can often be heard. However, if the target is far away, the user has hearing difficulties, or is wearing hearing protection, it may be difficult or impossible to hear the sound. In such instances, a viewer (e.g., the shooter, spotter, etc.) must look for the movement of the target due to the bullet impact. Detecting an impact using this method may be difficult or impossible, even with a scope or binoculars.

Currently, several systems are available that are designed to detect an impact on a target and inform a viewer that the target has been impacted. In these systems, multiple disparate components are connected together to form an indicating system. For example, a sensor unit is attached to the rear of the target or to the target support structure to sense impact. A light-producing indicating unit is placed a distance away from the target to reduce the chance of damage to the indicating unit by unintentional bullet strikes. The sensor is then connected to the light unit by wired or wireless means. Existing systems suffer various problems and deficiencies. Thus, it would be desirable to have a target hit indicator that would avoid at least some of the drawbacks of currently available systems.

SUMMARY OF THE INVENTION

Detecting an impact on a shooting target can often be difficult. Several systems are currently available that can detect a bullet impact and signal the impact to a viewer. Such systems have several problems, however. These systems can be cumbersome to set up, may not be weather resistant, or may not have long standby life, thus requiring the user to travel to the target to install and set up the system each time it is used. In the case of a target 1,000 yards away, a user may need to travel a significant distance to the target and back to set up and take down the system. Subject matter disclosed herein may overcome, eliminate, reduce or solve the aforementioned problems.

Additionally, even though the light-producing unit is placed a distance from the target, it may still be prone to damage and if a wired connection is used between the sensor and the light-producing unit, the wires themselves may be damaged. Wireless connections, on the other hand, may be costly or unreliable and may add significant power drain, resulting in the need for large batteries or frequent battery changes. Subject matter disclosed herein may overcome, eliminate, reduce or solve the aforementioned problems.

One of the challenges of a target-mounted target hit indicator is the harsh shooting environment on and around the target. Bullets by their nature are destructive on impact. Even collateral impacts from rocks or shrapnel can cause significant damage. Therefore, it is advantageous to shield the target hit indicator from such conditions. Currently available systems use a sensor mounted to the rear of the target or to the structure holding the target. Mounting to the rear of a target provides protection from direct bullet strikes but also presents a problem in that there is no direct line of sight from behind the target to the user (e.g., shooter, spotter, etc.). Current systems solve this problem by providing a separate signaling unit which is placed a distance from the target to reduce (but not eliminate) the likelihood of damage. A wired or wireless connection is then used to communicate between the sensor unit and the signaling unit. These wired connections may themselves be prone to damage while wireless systems may be unreliable and consume a lot of power. Additionally, many systems may not be weather resistant. Consequently, such systems may be cumbersome, prone to damage, have short battery life, and require setup and take-down with each use. Subject matter disclosed herein may overcome, eliminate, reduce or solve the aforementioned problems.

It is one object of embodiments to provide a unitary target hit indicator by consolidating disparate components of current systems to form a single integrated device. It is also an object of this disclosure to provide a target hit indicator that consumes very little power but is still visible at long distances (e.g., 1,000 yards or more).

In embodiments, the unitary design of the target hit indicator may eliminate the need for a separate sensor unit and indicator unit which simplifies the packaging and setup of the device. Necessarily, the need for a wired or wireless connection also may be eliminated, resulting in increased reliability and reduced power consumption.

Additionally, it is an object of this disclosure to provide a target hit indicator that is weather resistant and has a long standby time, allowing the target hit indicator to be left on a target outdoors for an extended period of time and thus eliminating the need to set up and take down the target hit indicator each time it is used. It is a further object of this disclosure to provide a target hit indicator that can differentiate between an impact and a miss and signal to a user accordingly.

In embodiments, power consumption may be reduced by incorporating a low-power standby mode. Unnecessary components can be powered down in a low-power standby mode while the target hit indicator "listens" for an event generating one or both of initial vibration information and initial acoustic information above one of the vibration standby wake threshold and the acoustic standby wake threshold.

To these ends, a unitary target hit indicator is provided that may be mounted to the rear of a target and detect an impact and signal to a viewer that an impact and/or a miss has occurred.

In embodiments, a unitary target hit indicator may include a microcontroller unit, an impact sensor, and an impact indicator. The target hit indicator may further include an acoustic sensor. The target hit indicator may receive impact information from the impact sensor, determine whether a projectile impacted the target, and trigger the impact indicator to signal a successful impact based on the determination. Acoustic information may be further received from the acoustic sensor. If the target hit indicator determines that a miss has occurred, the impact indicator may be triggered to signal a miss based on the determination. A unitary target hit indicator may further include a light redirection element to allow the target hit indicator to be placed behind a target and reflect light from the impact indicator around the edge of the target toward a user.

The impact indicator may comprise the light redirection element and a light source. In embodiments the impact indicator may comprise a miss indicator, which may be configured to be activated responsive to the determination that a shot has been fired, but the projectile has not directly impacted the target. The light redirection element may be made of a flexible or rigid material and may have a light entrance area for receiving light from the light source, and a light exit area. The light redirection element may comprise one or more materials that are transparent, translucent, opaque, or reflective. Thus, at least a portion of the light received from the light source via the light entrance area, may be redirected, and be transmitted towards the user via the light exit area. One or more collimators substantially aligned with the impact indicator may be used to collect light from the light source to help direct the light toward the user.

In an embodiment, a method of indicating whether a target has been impacted may include receiving, from the impact sensor by the microcontroller unit, initial vibration information, determining whether the initial vibration information is above a vibration standby wake threshold and if the initial vibration information is above the vibration standby wake threshold: receiving, from an impact sensor by a microcontroller unit, vibration information, processing the vibration information (e.g. by integration), determining whether the vibration information is above a vibration impact threshold, and if the vibration information is above a vibration impact threshold, indicating a hit via the impact indicator. The method may further include indicating a miss via the impact indicator if the vibration information is not above the vibration impact threshold.

Alternatively, in an embodiment, such a method may include receiving, from an acoustic sensor by the microcontroller unit, initial acoustic information, determining whether the acoustic information is above an acoustic standby wake threshold and if the initial acoustic information is above the acoustic standby wake threshold, receiving, from an impact sensor by a microcontroller unit, vibration information; processing the vibration information (e.g. by integration); determining whether the vibration information is above a vibration impact threshold; and, if the vibration information is above a vibration impact threshold, indicating a hit via the impact indicator. The method may further include indicating a miss via the impact indicator if the vibration information is not above the vibration impact threshold.

The target hit indicator may utilize a low-power standby mode to conserve battery life when not in use. However, upon detection of an event above one of the standby wake thresholds, full power to some or all of the components can be restored.

Generally, the narrower the beam of light from the light redirection element to the viewer, the less intense the light source must be to be observable at distance. Collimators help collect light and direct the light into a narrow beam. Therefore, the use of collimators may allow for the use of a lower intensity light source which, among other advantages, ultimately results in increased battery life for the target hit indicator.

Similarly, a narrower beam also has a smaller field of view. Therefore, adjustable housing positions allow a narrow beam of light to reach a user and thus reduce the intensity of the light source (and resulting power consumption) required for the target hit indicator to be effective.

By eliminating the need to transmit a signal from one piece of a target hit indicator to another across a significant distance, by optimizing the transmission of light to the user, and further by incorporating a low-power standby mode, a unitary target hit indicator may have very low power requirement. In embodiments, such a target hit indicator that may have a battery life of months or even years. In embodiments, a target hit indicator may have a power demand that is a minor fraction of power demand of other target hit indicators, with accompanying increased battery life.

In embodiments, the unitary design of the target hit indicator also may allow it to be sealed, providing environmental protection for the electronics, thereby contributing to the devices' ability to be left on a target exposed to uncontrolled weather for extended periods of time. Advantageously, a user need not remove the target hit indicator after a shooting session, nor does the user need to travel to the target to turn the unit off.

The target hit indicator, in embodiments, may perform an integration or other processing of data received from its sensor(s) and use the integrated data to more accurately differentiate between a hit and a miss.

In an embodiment, a target hit indicator may include, or may be in communication with, an acoustic sensor which may also be used to sense a projectile that passes nearby but does not impact the target. Such information may be used to trigger the impact indicator to indicate a miss. By indicating a miss in this manner, the target hit indicator may provide a user with confirmation that the target hit indicator is functioning whether or not the target is impacted.

These and other advantages will become apparent in the following disclosure with reference to the accompanying drawings.

BRIEF DESCRIPTION OF THE DRAWINGS

The exemplary embodiments are illustrated by way of example and not limitation in the accompanying figures.

DETAILED DESCRIPTION

Although the description herein is directed to indicating the impact of a bullet on a target, one of ordinary skill in the art would recognize that such a device may be used to indicate an impact on any object. Further, such an apparatus may be used to indicate vibration, acceleration, movement, etc.

A target may refer to any object that a user wishes to detect vibration in or movement of (e.g., as a result of a projectile impact). For the purposes of this disclosure, the front of a target may be any portion of the target which is intended to be impacted with a projectile and the rear (or back or "behind") of a target is any portion which is not intended to be impacted with a projectile (although impact may occur due to ricochet, etc.).

Within this disclosure, the term "or" refers to the conjunctive and not just the alternative unless expressly stated otherwise. For example, "a or b" may refer to "a" only, "b" only, or "a" and "b".

Figure 1A:
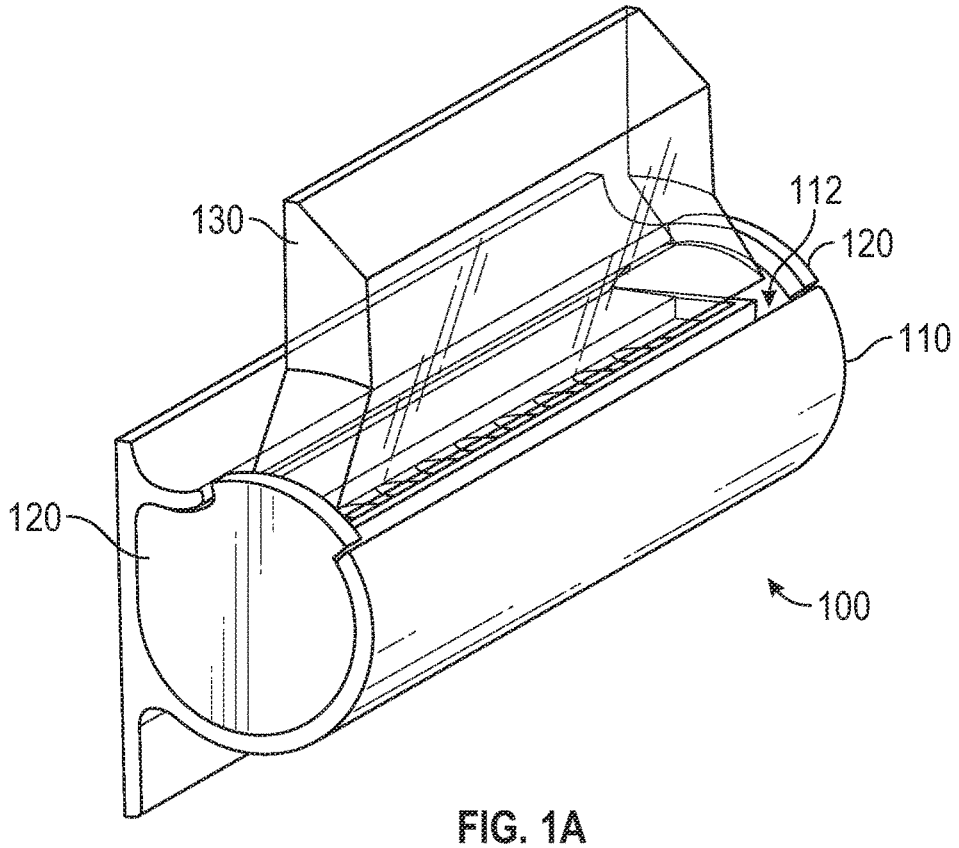
FIGS. 1A-B show one embodiment of a target hit indicator.
Figure 1B:
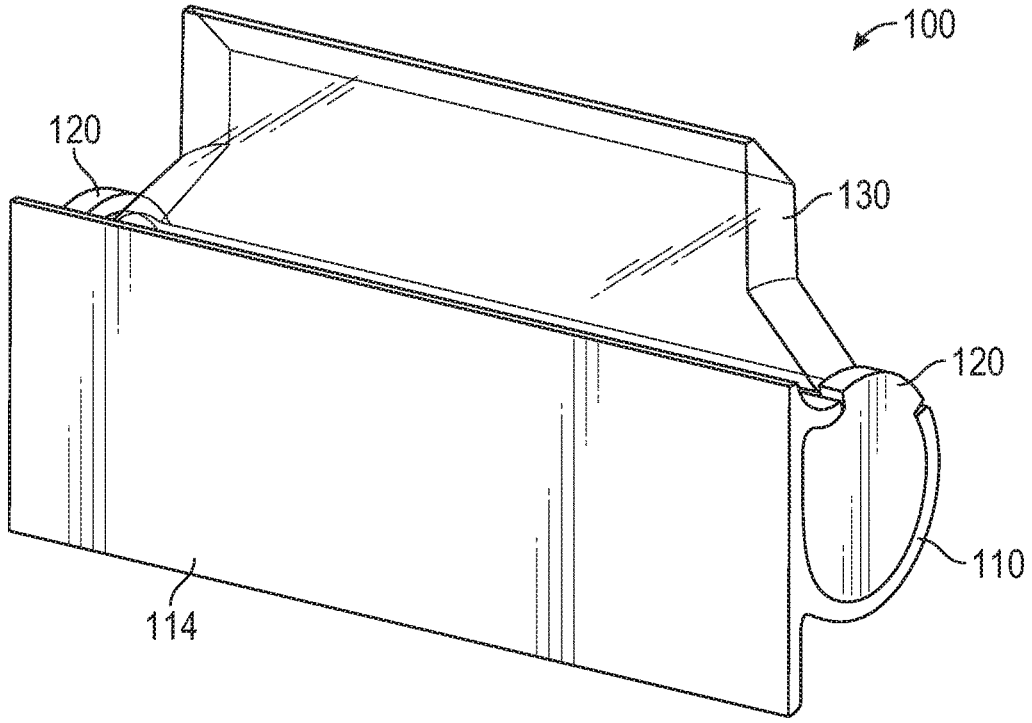
Figure 2A:
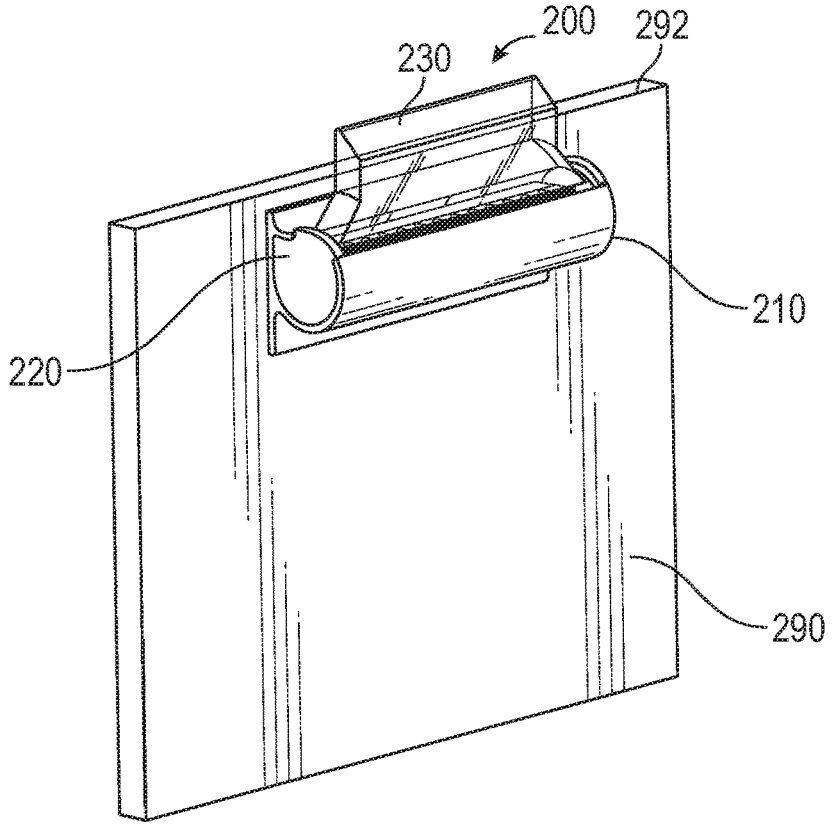
FIGS. 2A-D show one embodiment of a target hit indicator with a rectangular target.
Figure 2B:
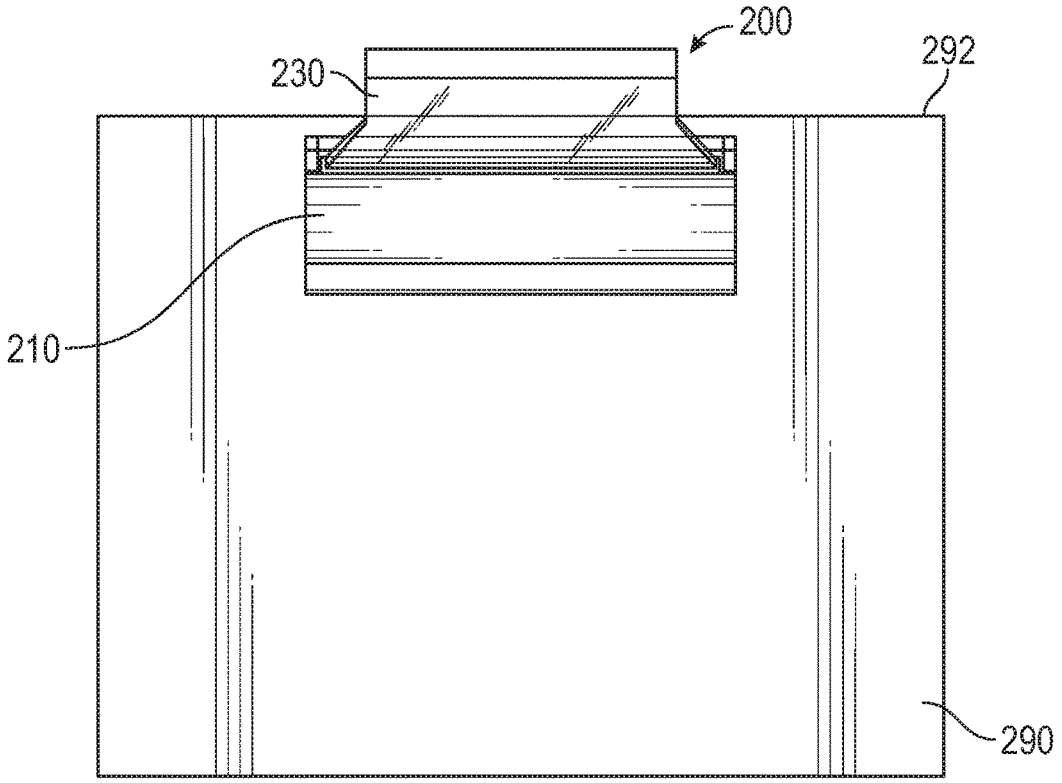
Figure 2C:
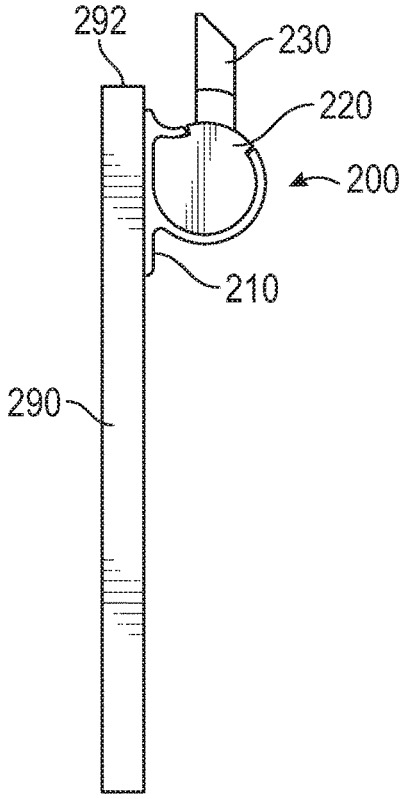
Figure 2D:
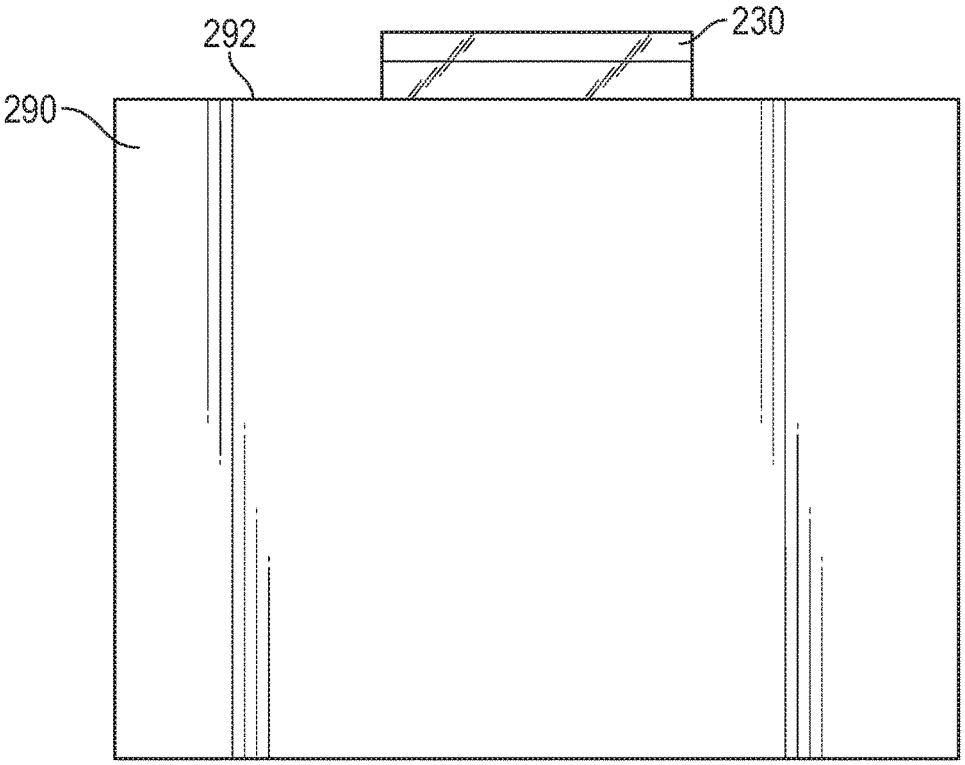
Figure 3A:
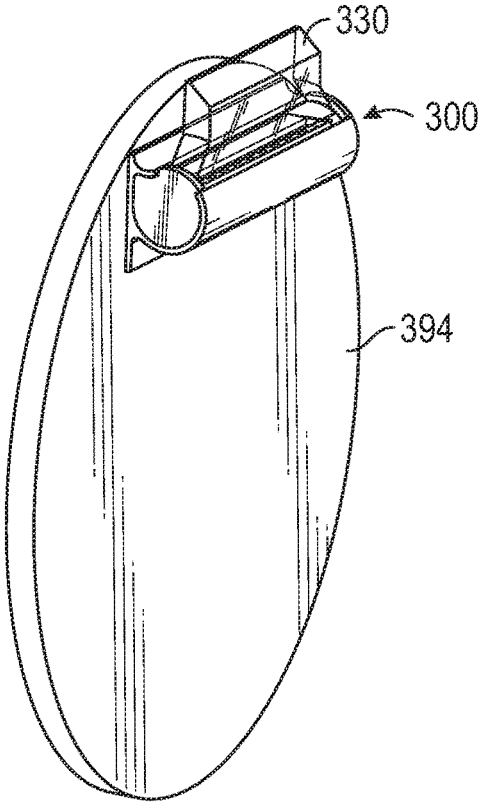
FIGS. 3A-D show one embodiment of a target hit indicator with a circular target.
Figure 3B:
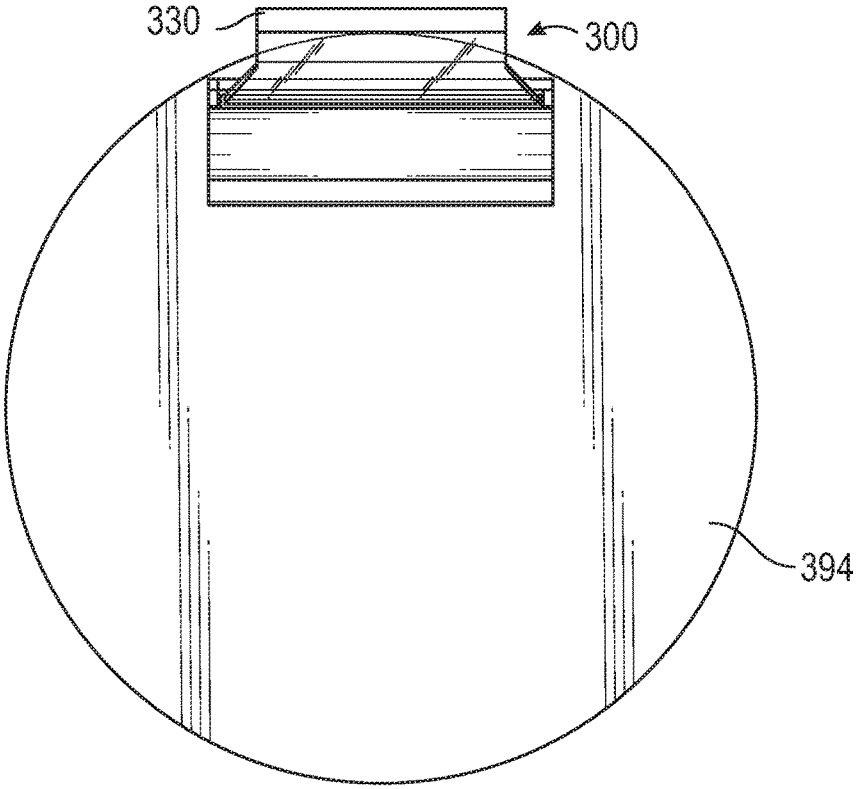
Figure 3C:
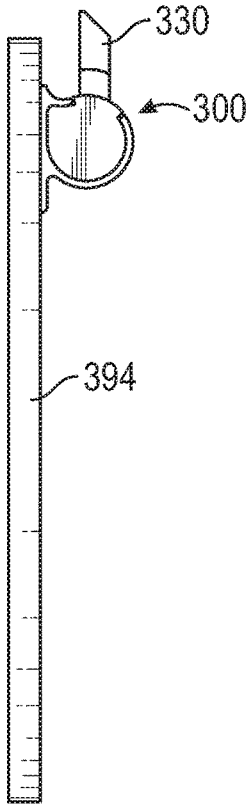
Figure 3D:
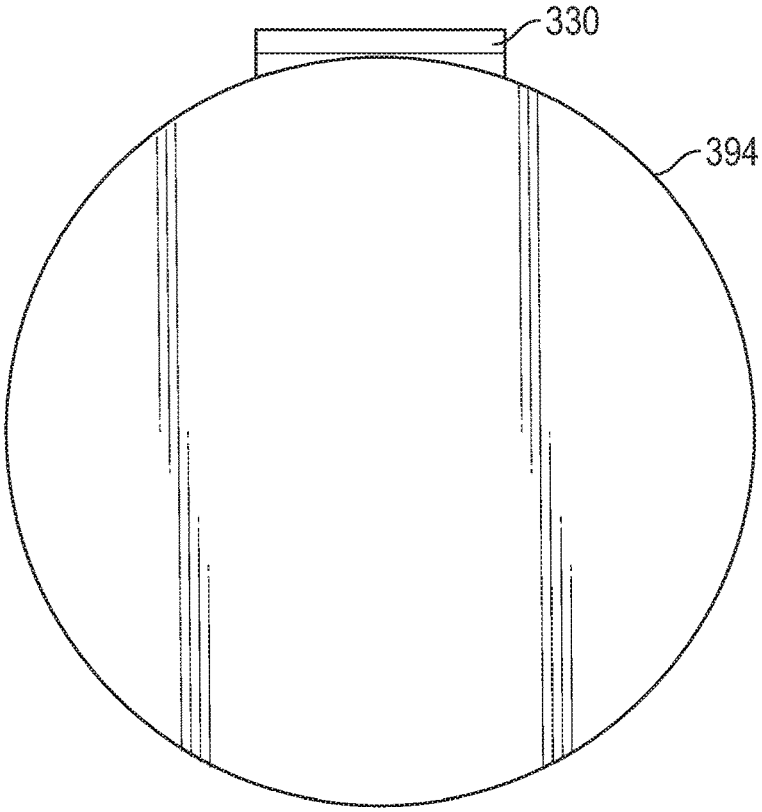

Turning now to FIGS. 1A-1B, an embodiment of a target hit indicator 100 is shown. A housing 110 defining an interior volume 112 for holding components of the target hit indicator (e.g., the electronic components). Housing 110 comprises a mounting surface 114 for attaching the target hit indicator 100 to a target. Mounting surface 114 may have any suitable shape or orientation. Housing 110 and endcaps 120 may provide protection for the components of the target hit indicator and may provide protection from environmental conditions such as dust, dirt, etc., or debris such as flying rocks or shrapnel produced by a nearby bullet strike.

Components held within the housing 110 may include sensors for sensing an impact as well as indicators for indicating an impact, a miss, or other information. The indicators in the embodiment shown in FIGS. 1A-1B are light sources in the form of a plurality of light emitting diodes (LEDs). Generally, a light source within the visual spectrum of light may provide the most easily detectible signals; however, in some embodiments it may be advantageous to use an infrared or other non-visible light source for signaling hits/misses. Furthermore, in embodiments the light source may comprise other types of light sources, including one or more of: light emitting diode, laser, incandescent light bulb, arc lamp, gas-discharge lamp, or flash tube. Target hit indicator 100 may further comprise a light redirection element 130 positioned so as to reflect light from the impact indicator light source(s) to a viewer. As depicted in the embodiment shown in FIGS. 1A-1B, light redirection element 130 may be made of a transparent or translucent material for directing the light produced by the plurality of light emitting diodes (LEDs) which function as the impact indicators. Light redirection element 130 may allow the target hit indicator to be placed on the rear of a target to protect the components of the target hit indicator from damage by a direct bullet strike yet still make the light output from the indicators visible to viewers of the target. Thus, light redirection element 130 may direct light from the indicators around the edge of the target toward a viewer. This can be seen more clearly with reference to FIGS. 2A-2D and 3A-3D.

In embodiments, the light source may comprise one or a plurality of light sources capable of emitting different colored lights or different flash patterns responsive to different determinations made by the microcontroller. For example, a determination of a hit may trigger a red light, while the detection of a miss may trigger a yellow light. In another example, a first hit may trigger a green light, a second subsequent hit may trigger a blue light, and a third consecutive hit may trigger a purple light. In such multi-hit configurations, a determination of a miss, a signal from the user, or the passing of a predetermined time period between hits may reset the hit count.

FIGS. 2A-2D show one embodiment of a target hit indicator 200 attached to the rear of a rectangular target 290. In the illustrated embodiment, only light redirection element 230 extends beyond the top edge 292 of target 290 while the remainder of the target hit indicator 200 remains within the periphery of the target 290. Because of this placement, target 290 protects all but light redirection element 230 of target hit indicator 200 from damage due to direct impact. Light from the target hit indicator 200 passes through light redirection element 230 and is reflected around the edge of the target 290 and back up-range and may thus be visible to one or more viewers despite the indicator being positioned behind the target.

Light redirection element 230 may be adjustable relative to the housing 210 so as to allow the light to be aimed towards the viewers. For example, light redirection element 230 may be rotated within housing 210 to aim light to a viewer at lower or higher elevation than the target. Endcaps 220 may hold light redirection element 230 from freely rotating during use. Endcaps 220 may be configured to allow for little or no rotation of the endcaps 220 within or about housing 210. One embodiment of such a configuration based on an asymmetric shape of endcaps 220 may be seen in FIG. 2C. Friction between end caps 220 and light redirection element 230 may thus be used to hold light redirection element 230 from moving with respect to housing 210. Friction may be created by applying a force on the endcaps 220 such as by an elastic material stretched around the endcaps 220 or by manually-applied pressure, threaded fasteners, springs, or any other means. Additionally, end caps 220 may have bumps, ridges, or other features that interface with the light redirection element 230 and increase the friction between the end caps 220 and the light redirection element 230.

Light redirection element 230 may be formed of a flexible or "self-healing" polymer such that direct impact by a bullet causes minimal damage to the light redirection element 230. Additionally, light redirection element 230 may be replaceable in the event the light redirection element 230 becomes excessively damaged. Alternatively, in embodiments, a plurality of smaller light redirection elements, such as a plurality of light pipes, may be used in place of a single larger light redirection element. (See e.g., FIGS. 11A-F). In alternate embodiments, a rigid material may be used for the one or more light redirection elements 230 which may break away from the target hit indicator in the event of an impact. (See e.g., FIGS. 11A-F).

Turning now to FIGS. 3A-3D, target hit indicator 300 may be attached to the rear of a circular target 394. Despite the curvature of the edge of circular target 394, only light redirection element 330 of target hit indicator 300 may be visible from a position facing the front side of the target (See, e.g., FIG. 3D), while the remaining portions of the target hit indicator 300 remain protected behind target 394.

Figure 4:
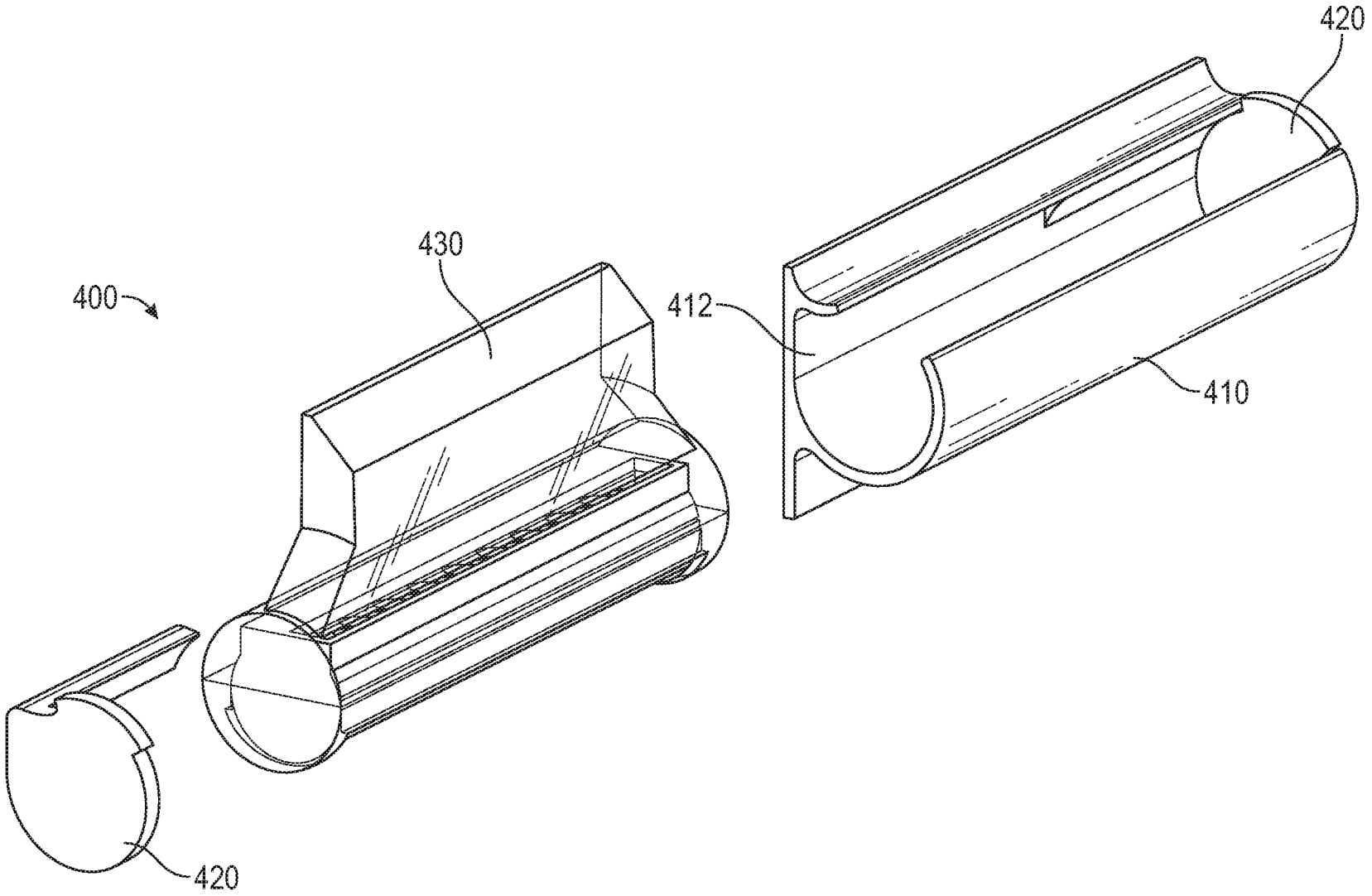
FIG. 4 shows an exploded view of a target hit indicator according to one embodiment.

FIG. 4 shows an exploded view of a target hit indicator 400 according to one embodiment. In this depiction, end cap 420 has been removed from housing 410 while the other end cap 420 remains installed in the housing 410. Light redirection element 430 and other components of the target hit indicator 400 are shown as removed from interior volume 412 of housing 410. This helps demonstrate one potential structure wherein target hit indicator 400 may be disassembled to replace light redirection element 430 or other components, and then reassembled for continued use.

Figure 5A:
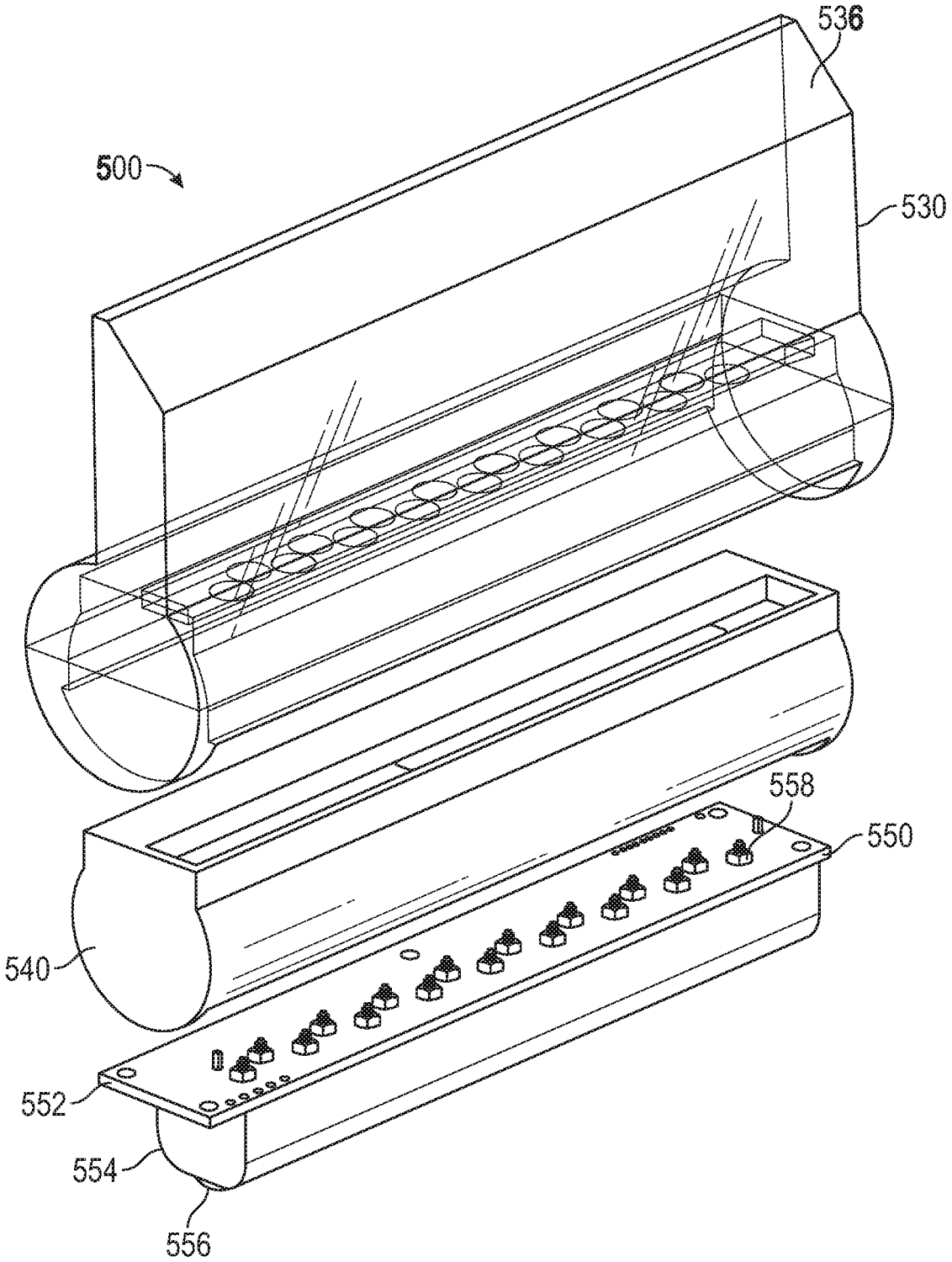
FIGS. 5A-B show an exploded view of some components of a target hit indicator according to one embodiment.
Figure 5B:
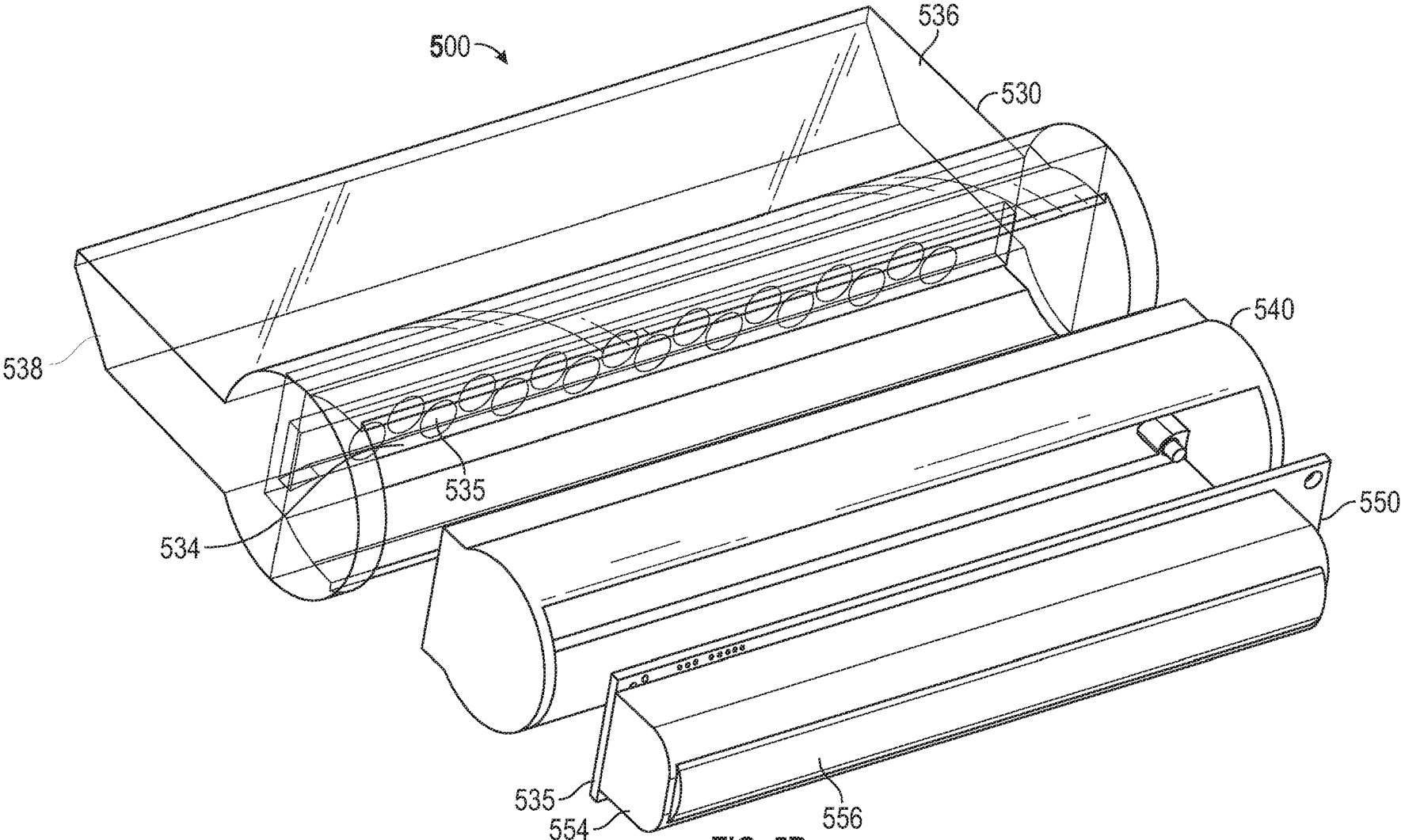

Turning now to FIGS. 5A and 5B, electronics holder 540 and electronics module 550 have been removed from pocket 532 of light redirection element 530. Electronics module 550 may comprise a printed circuit board 552, one or more light sources 558, and battery holder 554. One or more batteries 556 may provide power to the target hit indicator 500. Electronics module 550 may additionally comprise sensors, a microcontroller unit (MCU), a processor, and other electrical components (not shown).

Electronics module 550 may be held within electronics holder 540, which may be positioned to hold light source 558 against light entrance area 534 of light redirection element 530. Light redirection element 530 thus may provide protection for electronics module 550 from dirt, water, etc.

In operation, light from one or more light sources 558 passes into light redirection element 530 via light entrance area 534. The light is redirected by light redirection area 538, and exits the light redirection element 530 at light exit area 536. Light redirection area 538 of light redirection element 530 may redirect light by use of a reflective coating or by partial or total internal reflection. In one embodiment, light entrance area 534 may comprise one or more collimators 535 for collecting and focusing light produced by the one or more light sources 558.

Figure 6A:
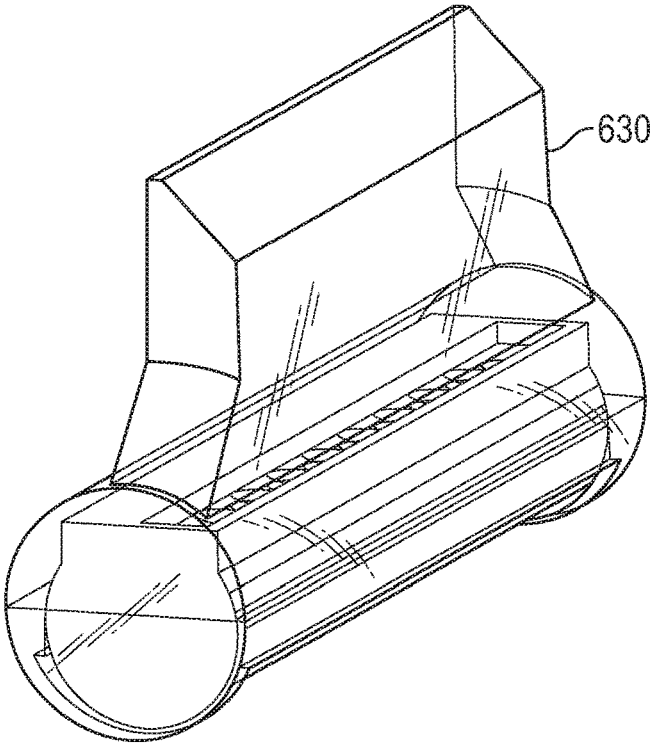
FIGS. 6A-B show an unexploded view of the components of FIGS. 5A-5B.
Figure 6B:
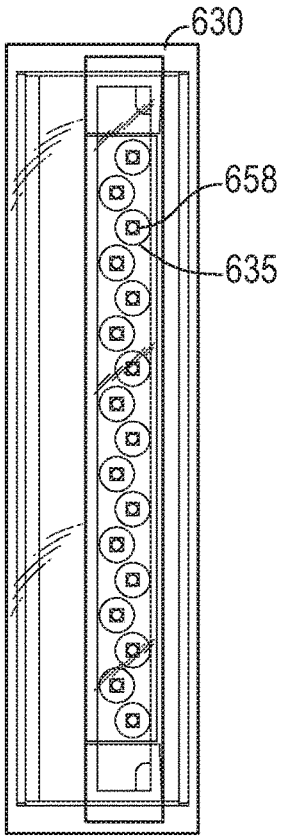

FIGS. 6A and 6B show an unexploded view of the components of FIGS. 5A and 5B, including light sources 658 and collimators 635. As can be seen in FIG. 6B, each collimator 635 of light redirection element 630 may be substantially aligned with each of light sources 658. Thus, light from each of light sources 658 may be collected by a collimator and directed around the edge of a target toward a viewer.

Figure 7:
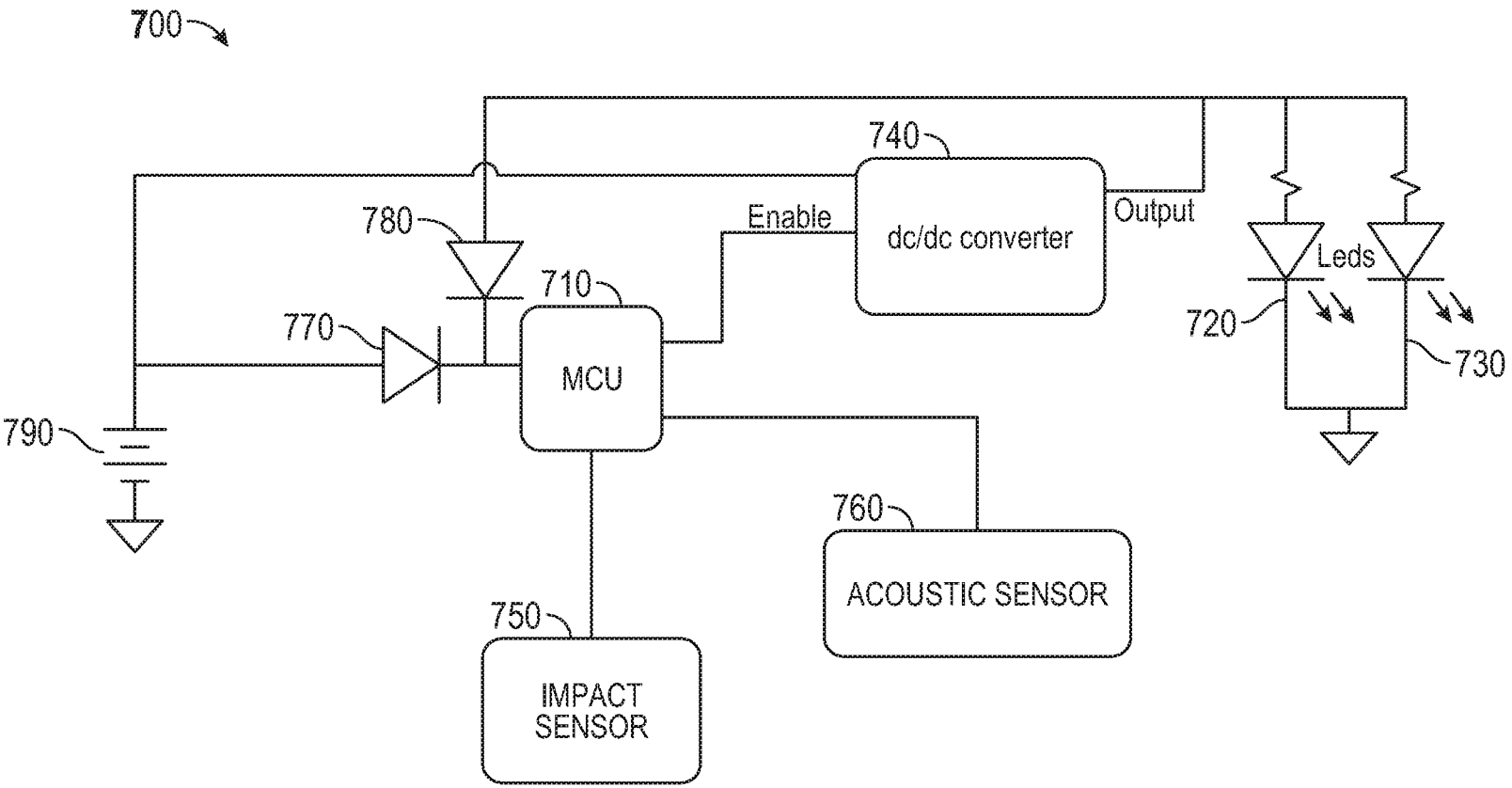
FIG. 7 shows an electrical schematic for a target hit indicator according to one embodiment.

FIG. 7 shows an electrical schematic 700 of a target hit indicator according to one embodiment. A power source 790 such as a battery may provide electrical power to various components of the target hit indicator, including microcontroller unit (MCU) 710, powering light sources 720 and 730, which may operate as impact and/or miss indicators. A dc/dc converter 740 may be used to provide power to the light sources 720 and 730, or other components. In another embodiment, the light sources 720 and 730 may be powered directly from power source 790, rather than by dc/dc converter 740. The dc/dc converter 740 may also be used to power MCU 710 in the event that the current draw from the light sources 720 and 730 causes the voltage from power source 790 to drop below the acceptable operating voltage of MCU 710. Diode 770 may prevent power from the dc/dc converter 740 from feeding back into power source 790 while diode 780 may allow MCU 710 to be powered by the dc/dc converter 740 without power source 790 continuously powering light sources 720 and 730.

In embodiments, a photovoltaic cell may be used as power source 790 or may be used in conjunction with power source 790, for example, to recharge a battery or a capacitor acting as power source 790.

In embodiments, one or more of an impact sensor 750 and an acoustic sensor 760 may be connected to MCU 710. The impact sensor 750 may be connected by a digital interface and the acoustic sensor 760 may be connected to a digital pin on the MCU 710. The impact sensor 750 may comprise an accelerometer and a comparator, and the acoustic sensor 760 may comprise a microphone and a comparator. In embodiments, a unitary target hit indicator may comprise a microcontroller, an impact sensor, and an impact indicator and may further include an acoustic sensor. In operation, acoustic information, impact information, or both is received by the microcontroller unit (MCU 710). Analysis by the MCU 710 using the acoustic information, impact information, or both, may enable a determination to be made regarding whether a target associated with the target hit indicator has been impacted. The impact indicator may be activated and signal a hit or a miss based on the determination. In embodiments, a light redirection element may include one or more light pipes which may be used to direct light from the impact indicator around the edge of a target towards a user, thus allowing a single unitary device to be mounted behind a target for protection from damage, but allowing light from the indicator to reach a user viewing the front of the target.

The MCU 710 may control power to the various components, such as the impact sensor 750 (e.g., accelerometer) and acoustic sensor 760 (e.g., microphone). Power to various components may be provided through a general purpose digital input/output pins from the MCU 710.

In various embodiments, impact sensor 750 may be one or more of a micro electrical machine (MEMS) sensor having programmable digital interrupt outputs, a piezo sensor, or an induction circuit. Impact information (e.g. acceleration values) from impact sensor 750 may be communicated to MCU 710 via a digital interface.

Figure 8:
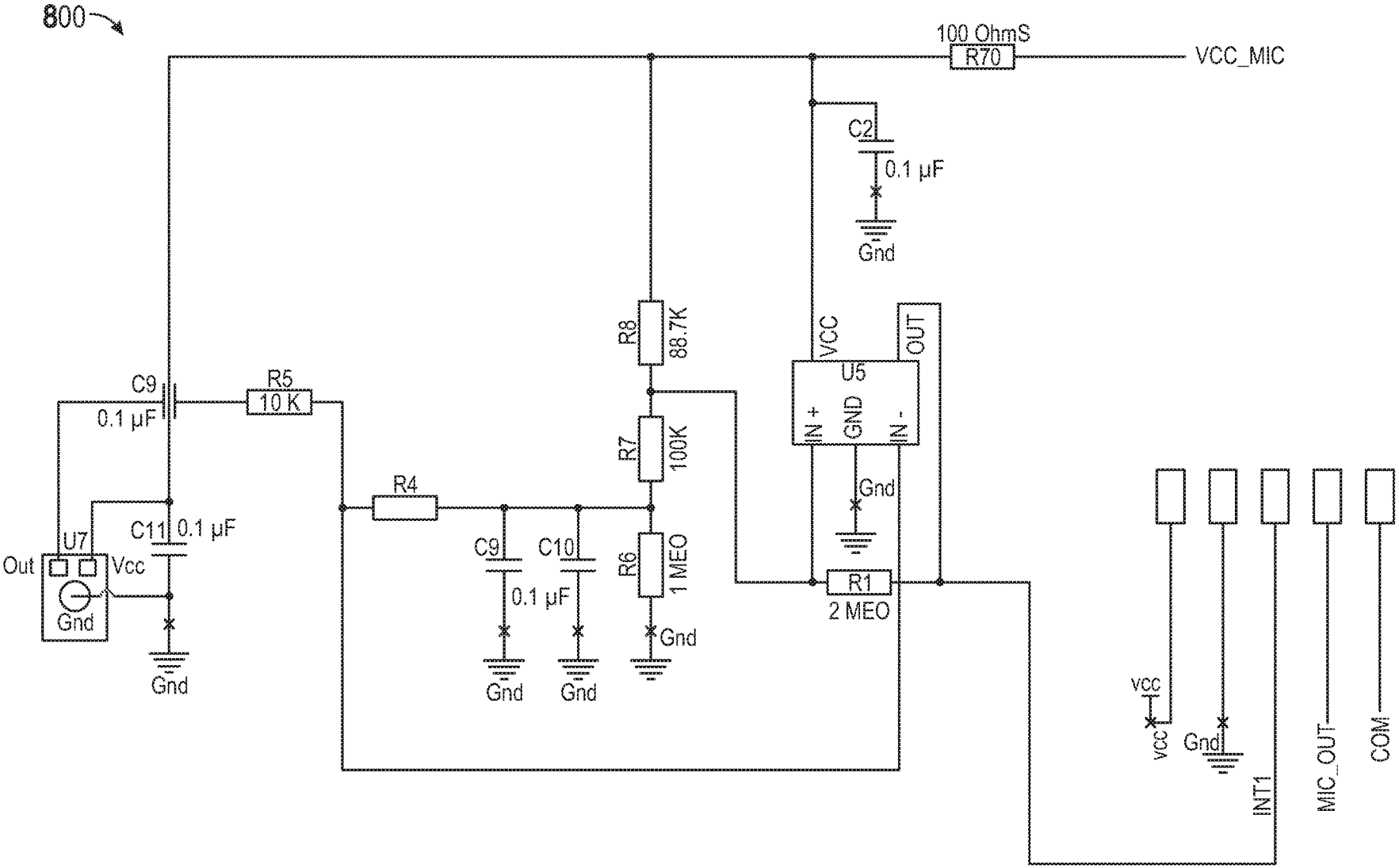
FIG. 8 shows an electrical schematic of a system having an acoustic sensor according to one embodiment.

Turning now to FIG. 8, an electrical schematic 800 of a target hit indicator system having an acoustic sensor according to one embodiment is shown. One skilled in the art will understand that there are many potentially suitable designs for a low-power acoustic input such as the one referenced herein. The embodiment shown in FIG. 8 uses an acoustic sensor comprising a micro-electrical-mechanical system (MEMS) microphone and a comparator to provide acoustic information in the form of a digital signal to the MCU. Generally, an external amplifier circuit may be used to increase the signal strength of a MEMS microphone. In the embodiment shown in FIG. 8, the target hit indicator is not concerned with acoustic fidelity, such that the analog signal from the microphone may be provided directly into a comparator. The comparator may determine whether the acoustic information exceeds a threshold, and this determination may be communicated to the MCU. In response, the MCU may wake the system from low-power standby mode and may activate a light source to indicate a hit or a miss, or take another action.

Figure 9:
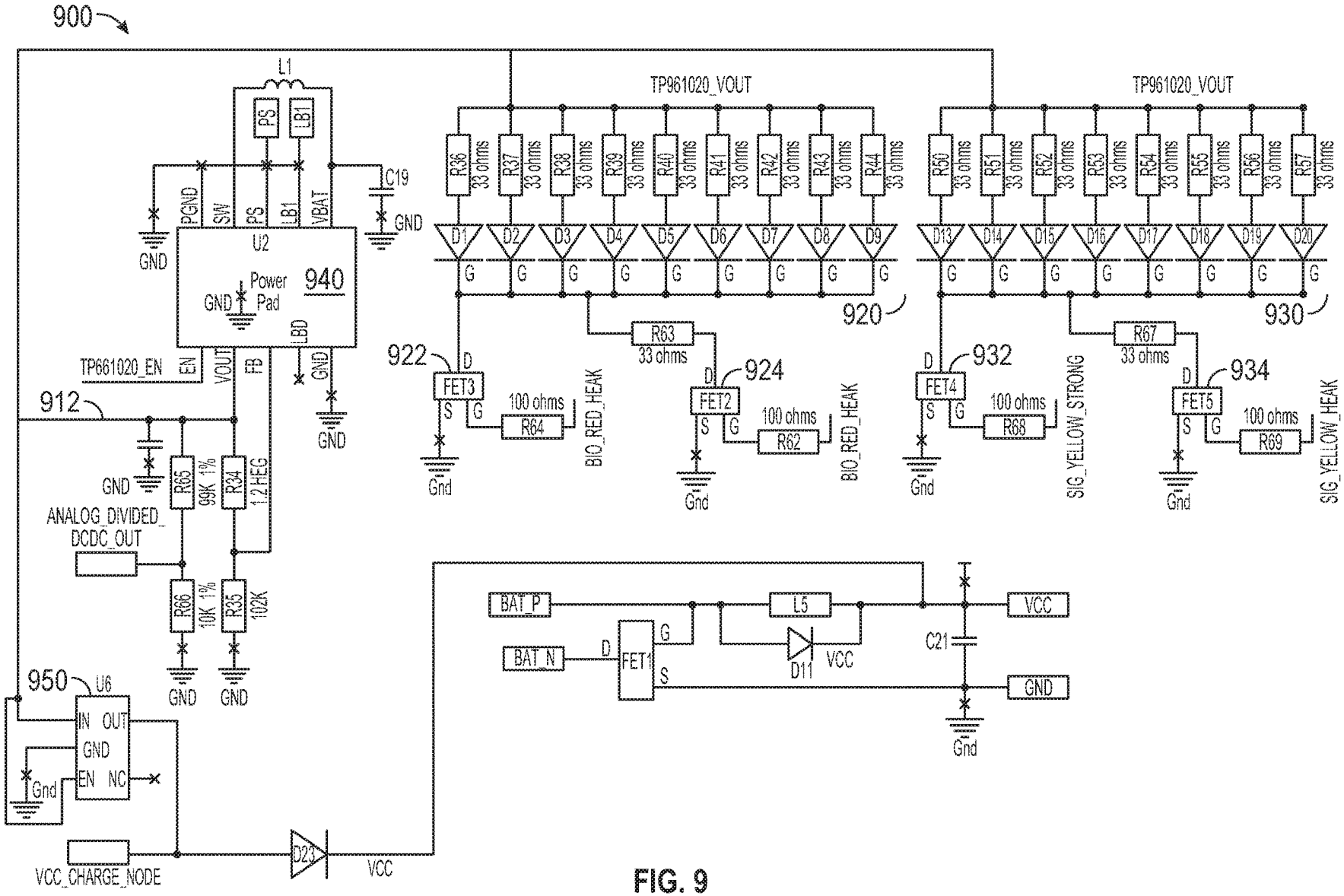
FIG. 9 shows an electrical schematic of an indicator circuit for a target hit indicator according to one embodiment.

FIG. 9 depicts an electrical schematic of an indicator circuit 900 for a target hit indicator according to one embodiment. In the embodiment shown, dc/dc converter 940 may be used to supply power to components of the target hit indicator via dc/dc converter output 912. For example, dc/dc converter 940 may be used to power the microcontroller unit, light sources 920 and 930, which may operate as impact and/or miss indicators, as well as the impact sensor and acoustic sensor. A voltage regulator 950 may be used to reduce the voltage from dc/dc converter output 912 to an appropriate voltage for some components.

Activation of the light sources 920 and 930, which may operate as impact and/or miss indicators, may be controlled by a microcontroller unit 190 via transistors 922, 924, 932, and 934. In the embodiment shown in FIG. 9, transistors 922 and 932 may be used to activate light sources 920 and 930 at full brightness. Alternatively, transistors 924 and 934 may be used to activate light sources 920 and 930 at a reduced brightness level. The brightness level may be user selectable or may be automatically selected (e.g., in the event that the power source is unable to supply the necessary current).

In an embodiment, a resistive divider network may also be used to drop the dc/dc converter output 912, such that the MCU may use an analog-to-digital converter to determine if the dc/dc converter 940 is performing correctly.

Figure 10A:
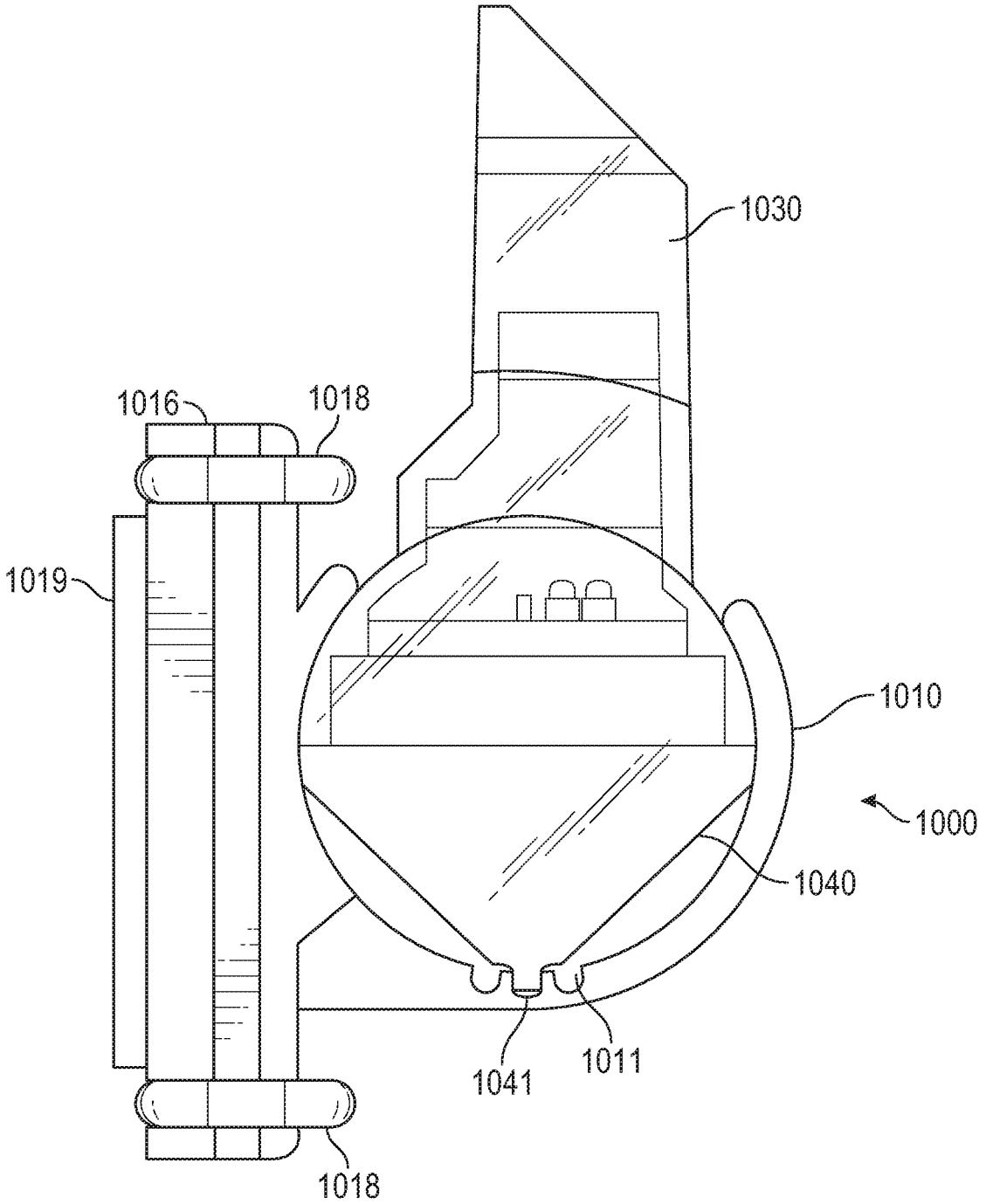
FIGS. 10A-B show one embodiment of a target hit indicator having a mounting plate.
Figure 10B:
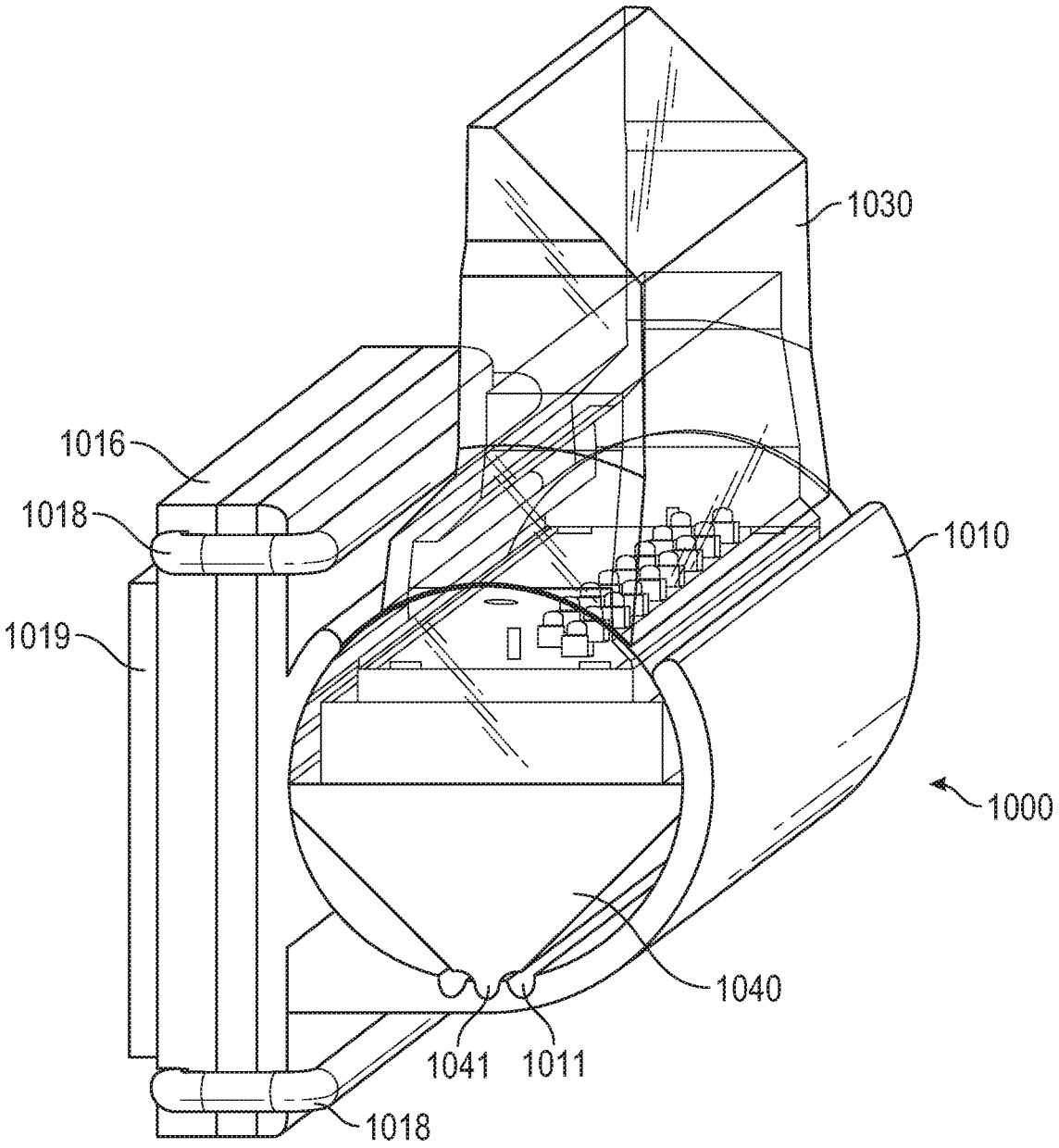

Turning now to FIGS. 10A-B, an alternative embodiment of a target hit indicator 1000 is shown. Similar to embodiments shown in FIGS. 1-5, electronics holder 1040 and a portion of light redirection element 1030 are held within the interior volume 1012 defined by housing 1010. Rather than attaching directly to a target, however, housing 1010 may be attached to mounting plate 1016 via elastic members 1018. Mounting plate 1016 in turn may be attached permanently or semi-permanently to a target or may be formed integrally with a target. For example, mounting plate 1016 may be attached to a target via adhesive tape 1019. Elastic member 1018 may rest in a groove in mounting plate 1016 and housing 1010 to hold the two together. Thus, housing 1010 may be quickly and easily attached to or removed from a target by installing or removing elastic members 1018. In one embodiment, elastic member 1018 may be a rubber O-ring.

Such a mounting system may provide other advantages in addition to ease of installation and removal of the target hit indicator 1000. When a projectile such as a bullet impacts a target, the target may experience a large acceleration both in the direction of bullet travel and also in the opposite direction. If the target accelerates away from the target hit indicator 1000, inertial forces are generated that act to pull the target hit indicator 1000 away from the target. Such forces may stress adhesive tape 1019 (or other attachment means) beyond its operational limit, thus undesirably causing the target hit indicator 1000 to detach from the target. Therefore, incorporating a means for dampening such large forces may help keep the target hit indicator 1000 attached to the target. In the embodiment shown in FIGS. 10A-B, elastic members 1018 may stretch, thus helping to decouple housing 1010 (and contents of housing 1010) from mounting plate 1016. Decoupling may result in lower peak stress on adhesive tape 1019, thus resulting in better adhesion of the target hit indicator 1000 to the target.

Additionally, as the inertial forces increase with the mass of the target hit indicator 1000, minimizing the mass adhered to the target also reduces the peak stress on the attachment means, such as adhesive tape 1019, and resulting in better adhesion. Minimizing the mass may be accomplished through the use of lightweight materials or compact design. For example, housing 1010 may be made of aluminum while electronics holder 1040 may be made of plastic. Additionally, electronics holder 1040 may have a shape that minimizes volume, such as by the triangular shape seen in FIGS. 10A and 10B that leaves open space between electronics holder 1040 and housing 1010.

In embodiments comprising a circular shaped housing (see FIG. 10A), the circular shape of housing 1010 may allow electronics holder 1040 and light redirection element 1030 to be rotated within housing 1010 to allow a user to adjust the direction of light output. Embodiments of the housing 1010 may contain a plurality of grooves 1011 into which electronics holder projection 1041 may be coupled. A user may align electronics holder projection 1041 with the desired groove 1011 and slide electronics holder 1040 and light redirection element 1030 laterally into housing 1010. Such an arrangement may provide a positive engagement, preventing electronics holder 1040 (and thus light redirection element 1030) from rotating due to vibration, impact, etc.

Figure 11A:
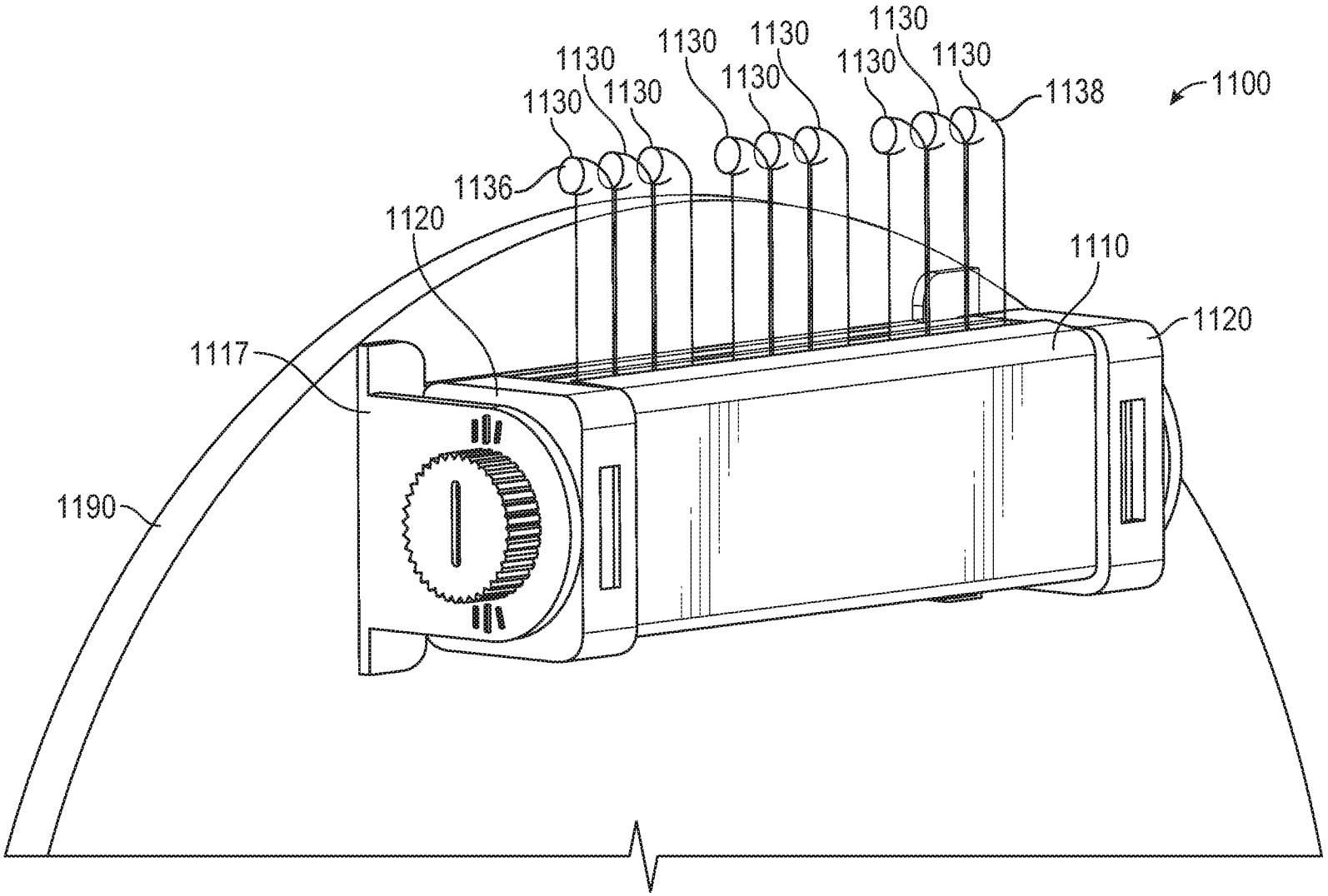
FIGS. 11A-F shows an embodiment of an adjustable target hit indicator having multiple light pipes.
Figure 11B:
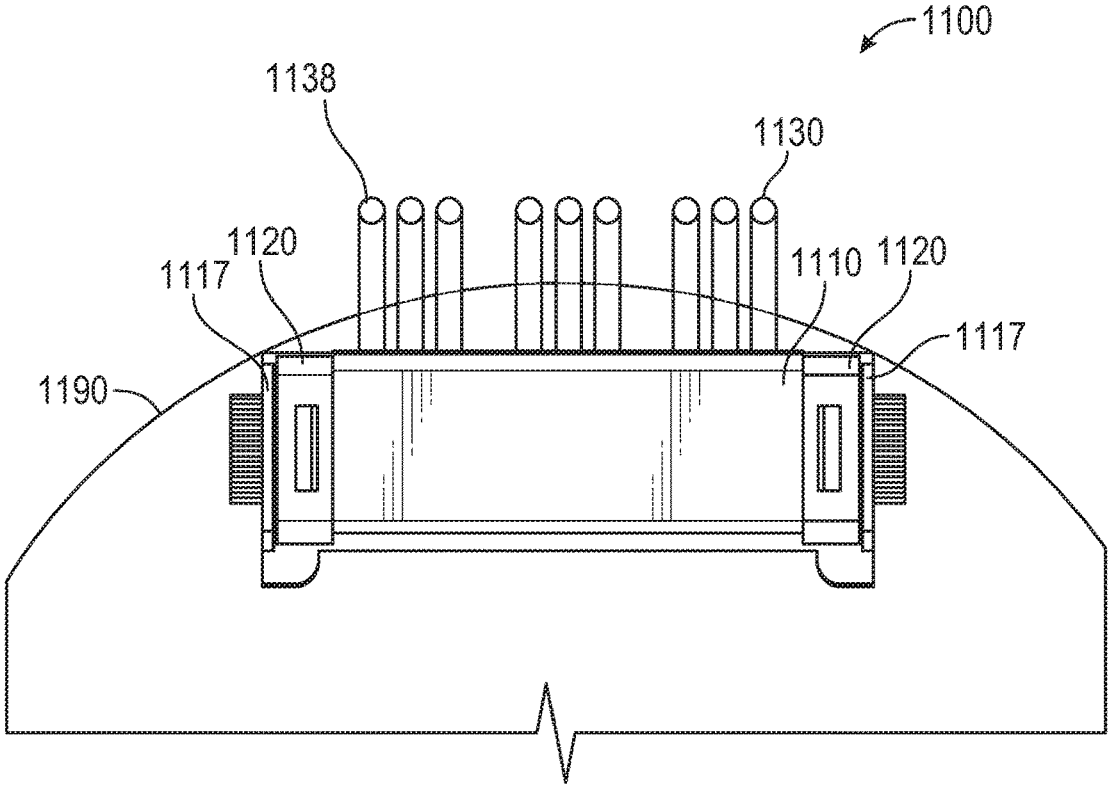
Figure 11C:
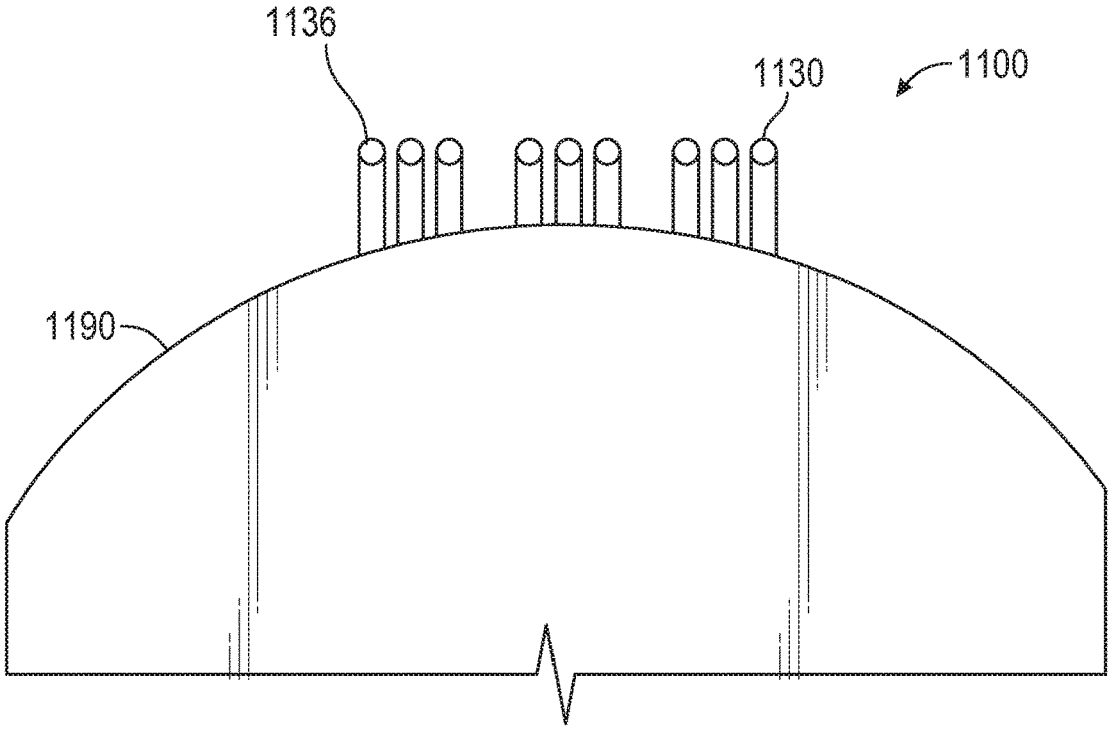

Turning now to FIGS. 11A-F, an alternative embodiment of a target hit indicator 1100 having a multiple light redirection elements in the form of light pipes 1130 is shown. FIG. 11C shows a front view of target 1190. As can be seen, target hit indicator 1100 may be positioned behind target 1190 so that only light pipes 1130 are visible.

Light pipes 1130 may be made of a rigid transparent or translucent material and may be designed to break away if impacted so as to not damage the rest of the target hit indicator 1100. Light pipes 1130 may be inexpensive and easy to replace when broken. Alternatively, light pipes 1130 may be deformable and/or self-healing so as to reduce the damage caused by impacts.

Each light pipe 1130 may be associated with a light source (such as an LED) contained within housing 1110. Thus, in the embodiment in FIGS. 11A-F, housing 1110 contains a light source consisting of nine LEDs, each substantially aligned with one of the nine light pipes 1130. Each light pipe 1130 may comprise a light entrance area (hidden by housing 1110) a light redirection area 1138, and a light exit area 1136.

Additionally, each light pipe 1130 may comprise a collimator to collect the light emitted by a light source substantially aligned with the collimator associated with each light pipe 1130 to produce a substantially parallel beam of light. When total internal reflection is used to reflect light, having a substantially parallel beam of light allows more light to strike the light redirection area 1138 at an angle greater than the critical angle, and thus more light may be reflected off the light redirection area 1138 and directed around the edge of the target 1190 and less light may be lost through the light pipe 1130.

Light from a light source of the may travel into a light pipe 1130 via a light entrance area (hidden by housing 1110). Light may reflect off a light redirection area 1138 of light pipe 1130 and then exit light pipe 1130 via a light exit area 1136. Thus, at least a portion of the light received from the light source via the light entrance area (hidden by housing 1110) may reflect off the light redirection area 1138 and exit the light pipe 1130 via the light exit area 1136. In this way, light produced by the light source from a protected location behind the target 1190 may be directed around the edge of the target toward a viewer.

Figure 11D:
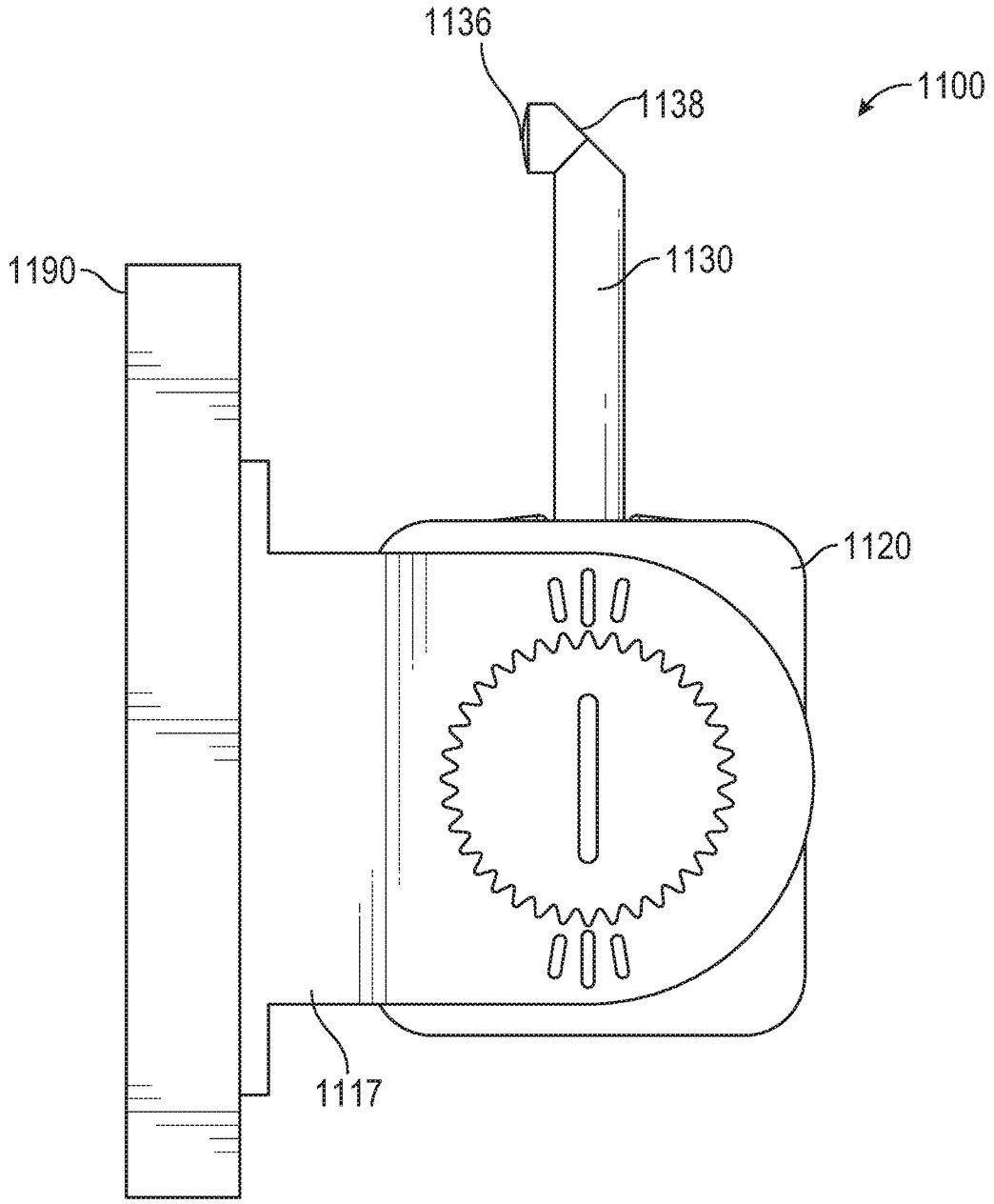
Figure 11E:
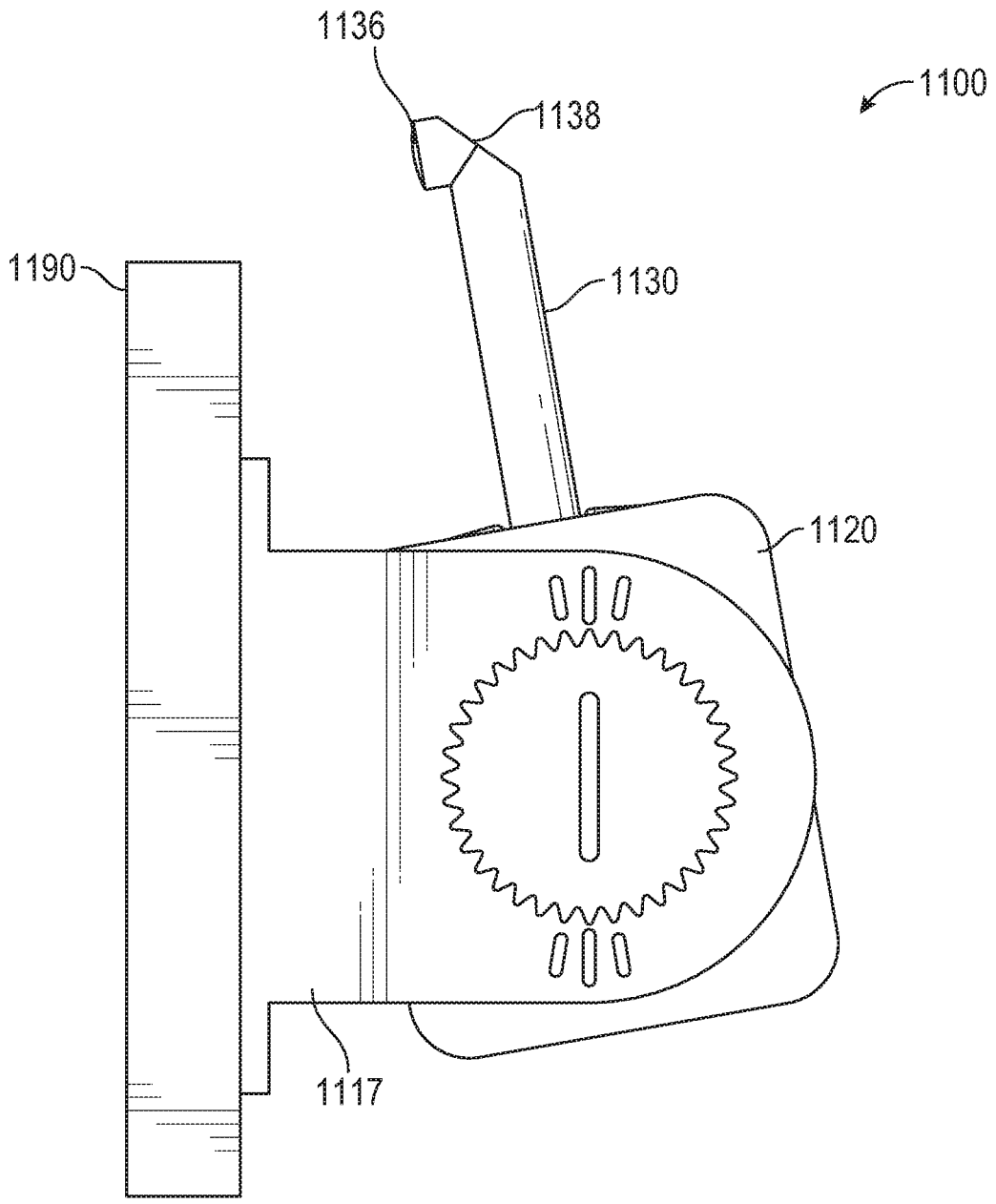
Figure 11F:
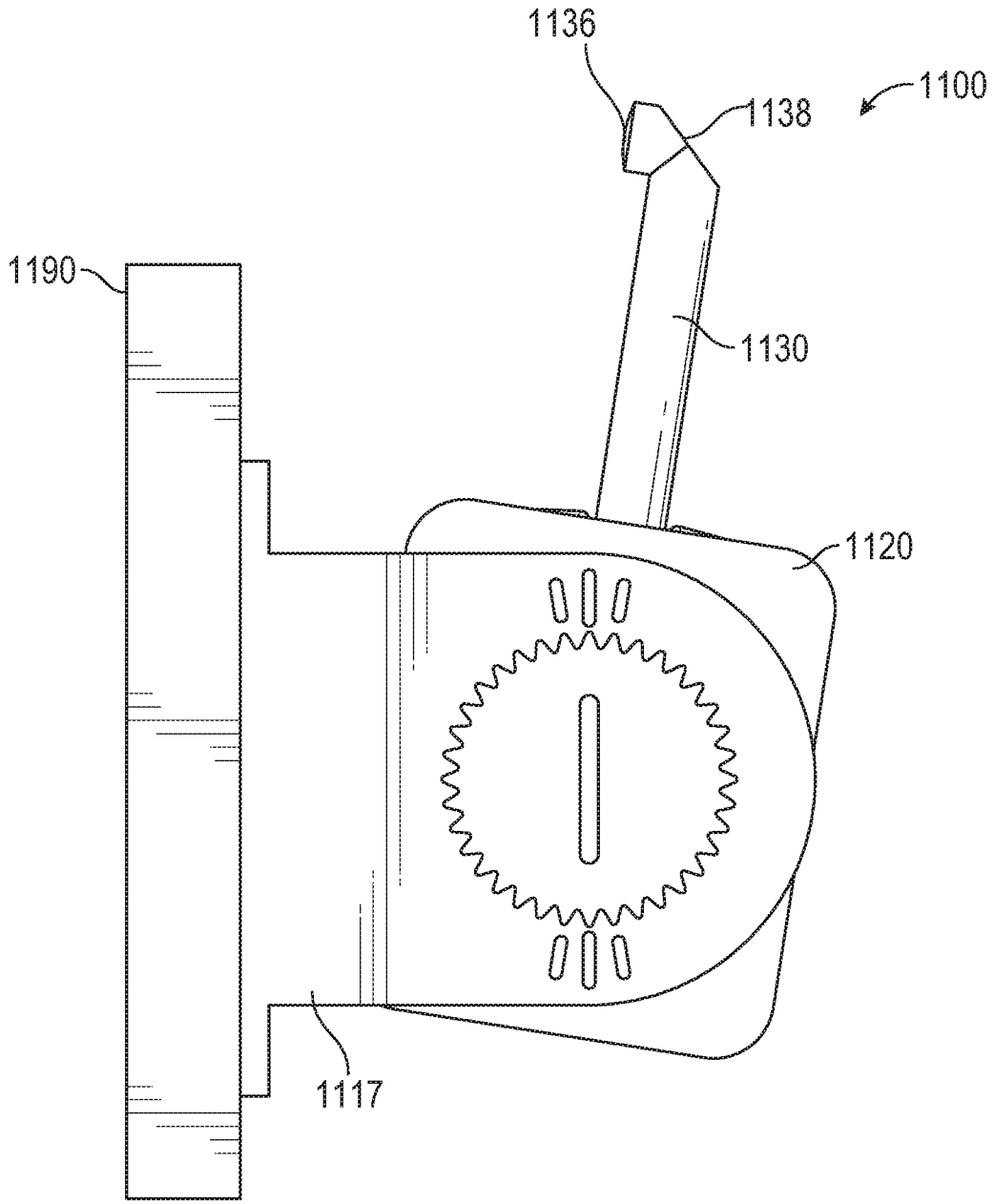

In embodiments, target hit indicator 1100 may be attached to target 1190 via mounting arms 1117. Endcaps 1120 may attach to housing 1110 and may have gear-shaped shafts that fit in a correspondingly-shaped opening in mounting arms 1117. Such a configuration may provide for different positioning of housing 1110 with respect to target 1190, allowing a user to aim the light exiting the light exit area 1136 of light pipes 1130 toward an intended viewer. FIGS. 11D, 11E, and 11F show a target hit indicator 1100 in a horizontal position, a below-horizontal position, and an above-horizontal position, respectively.

Figure 12A:
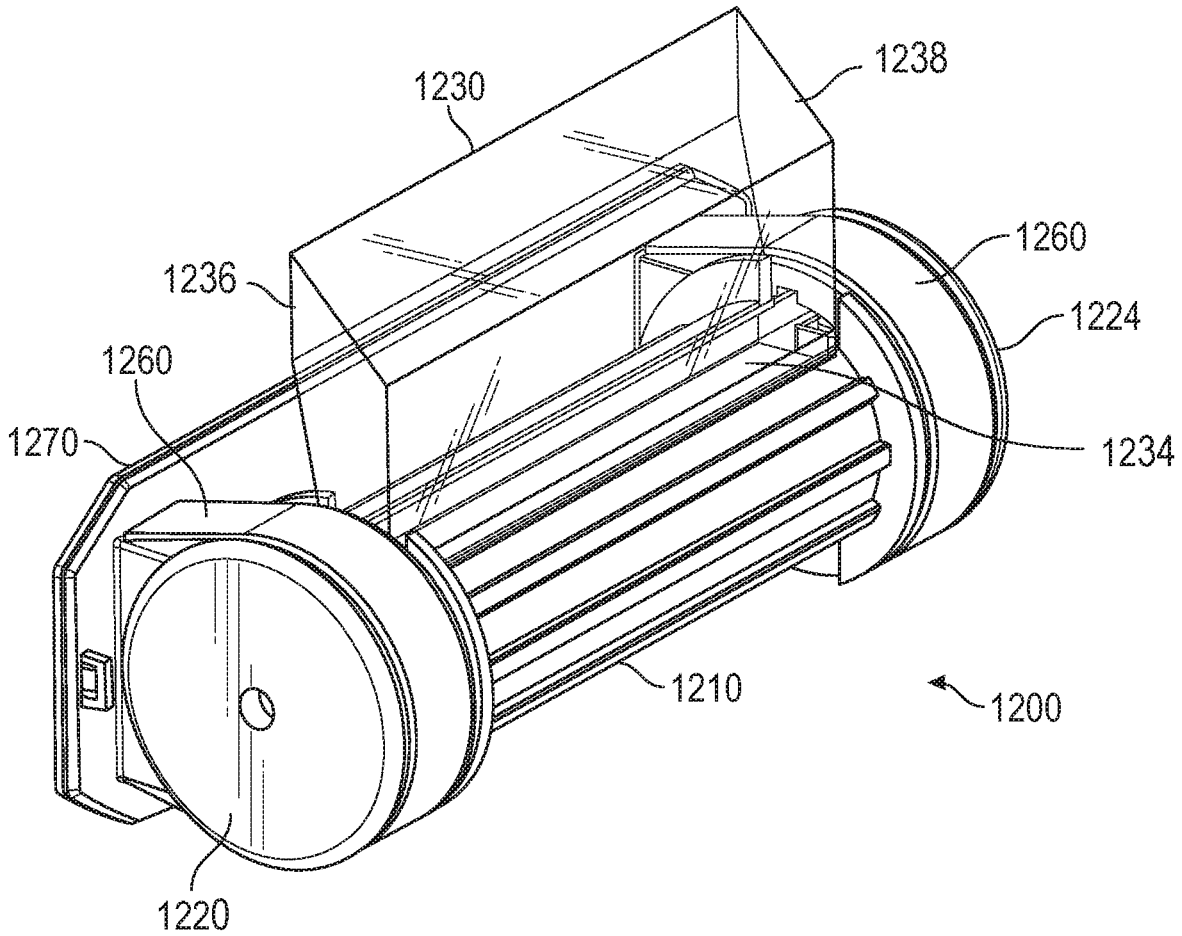
FIGS. 12A-B show an exemplary embodiment of a target hit indicator.
Figure 12B:
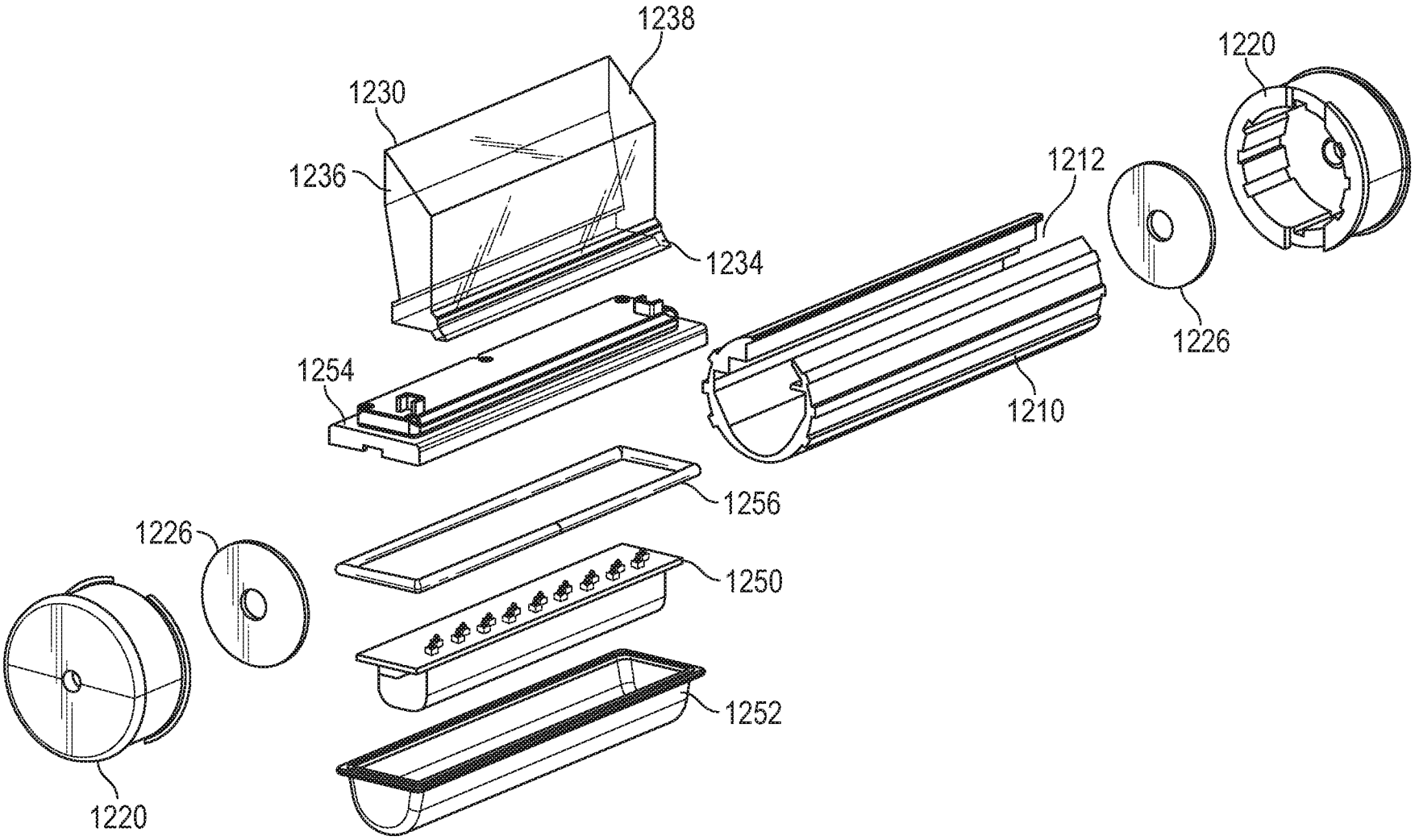

FIGS. 12A and 12B show an additional embodiment of a target hit indicator 1200. FIG. 12A illustrates target hit indictor 1200 in a fully assembled state while FIG. 12B is an exploded view of some components of target hit indicator 1200. In embodiments, an electronics module 1250 may be protected from the elements by electronics holder 1252, and lens 1254, either of which may be made of a rigid polymer. A seal 1256 prevents dust and liquids from reaching electronics module 1250. Lens 1254 may be made of a transparent or translucent material and may contain collimators for collimating light emitted by light sources of electronics module 1250. Light redirection element 1230 may comprise light entrance area 1234, light redirection area 1238, and light exit area 1236, and may be made of a flexible material and may be designed to rest against lens 1254. Housing 1210 comprises an interior volume 1212 shaped to hold lens 1254 against light redirection element 1230 thereby preventing dirt or other materials from interfering with light transmission between lens 1254 and light redirection element 1230. Interior volume 1212 also may be shaped to hold lens 1254 and electronics holder 1252 together and to compress seal 1256 sandwiched therebetween, thus creating a weather-resistant enclosure for electronics module 1250.

By integrating collimators into lens 1254, light redirection element 1230 is less complex than if the collimators were incorporated into lens 1254 in design. This allows for the benefit of making the article less expensive to manufacture. Additionally, as light redirection element 1230 may be a consumable part (in embodiments it may be the only consumable part in the device), this design may result in significantly reducing overall operating costs over the life of the target hit indicator 1200.

While electronics holder 1252 and lens 1254 provide mostly elemental protection for electronics module 1250 (e.g., water, dirt), housing 1210 provides mechanical protection for electronics module 1250 (e.g., impact). To this end, housing 1210 may be made of extruded metal such as aluminum or durable polymer such as glass filled nylon.

End caps 1220 may be made of a flexible material such as rubber and may provide additional weather and impact protection for electronics module 1250 in addition to retaining components 1250, 1252, 1254, 1256, and 1230 in housing 1210. Discs 1226 may be made of metal and may be placed inside end caps 1220 to provide additional impact protection.

Flexible straps 1260 may wrap around end caps 1220 to hold end caps 1220 against base plate 1270. End caps 1220 may therefore be prevented from sliding off of housing 1210, thereby maintaining all components of the target hit indicator together as a single unit. Housing 1210 may be rotated around the longitudinal axis with respect to base plate 1270 in order to aim emitted light toward intended viewer(s). Flexible straps 1260 may be loosened to allow housing 1210 to rotate to the desired position and then tightened in order to prevent rotation and otherwise secure the components to the base plate 1270.

Base plate 1270 may be attached to a target by means of, for example, hook and loop fasters. Hook and loop fasteners may be attached to base plate 1270 or may be molded integrally with base plate 1270.

Several features of target hit indicator 1200 facilitate secure attachment of the target hit indicator 1200 to a target, for example, by decoupling a substantial portion of the mass from the target. Hook and loop fasteners between base plate 1270 and the target may provide a strong yet flexible bond which may be able to remain attached during the intense vibrations caused by a bullet impacting a steel target. Flexible straps 1260 and end caps 1224 may operate as means for decoupling the target hit indicator 1200 from the target, further isolating the housing 1210 (and components held within) from impact and vibration. Such decoupling between housing 1210 and base plate 1270 significantly reduces the peak forces on hook and loop fastener 1270. In at least some instances, the peak forces on hook and loop fastener may be reduced below the maximum strength of the hook and loop fastener, thus providing a secure attachment method using commercially available hook and loop fasteners. Hook and loop fasteners are desirable because they provide inexpensive, easy, tool-less attachment and removal to nearly all existing target designs.

In certain embodiments, however, other attachments may be desired. In an embodiment, for example, a base plate may be attached to a secondary plate, with the secondary plate being attached using an existing mounting hole. Such a secondary plate may be made of metal, be pivotally attached to the base plate, and may have a hole for aligning with a preexisting hole in the target (e.g., a hole for mounting the target).

In embodiments, a base plate 1270 may also have one or more holes for fastening to a specially designed target. For example, a target may have appropriately placed holes for inserting one or more fasteners therethrough. The fastener(s) may pass through the one or more holes in the base plate. A nut or other fastening means may be placed on the fastener, thus holding the base plate onto the target.

Figure 13B:
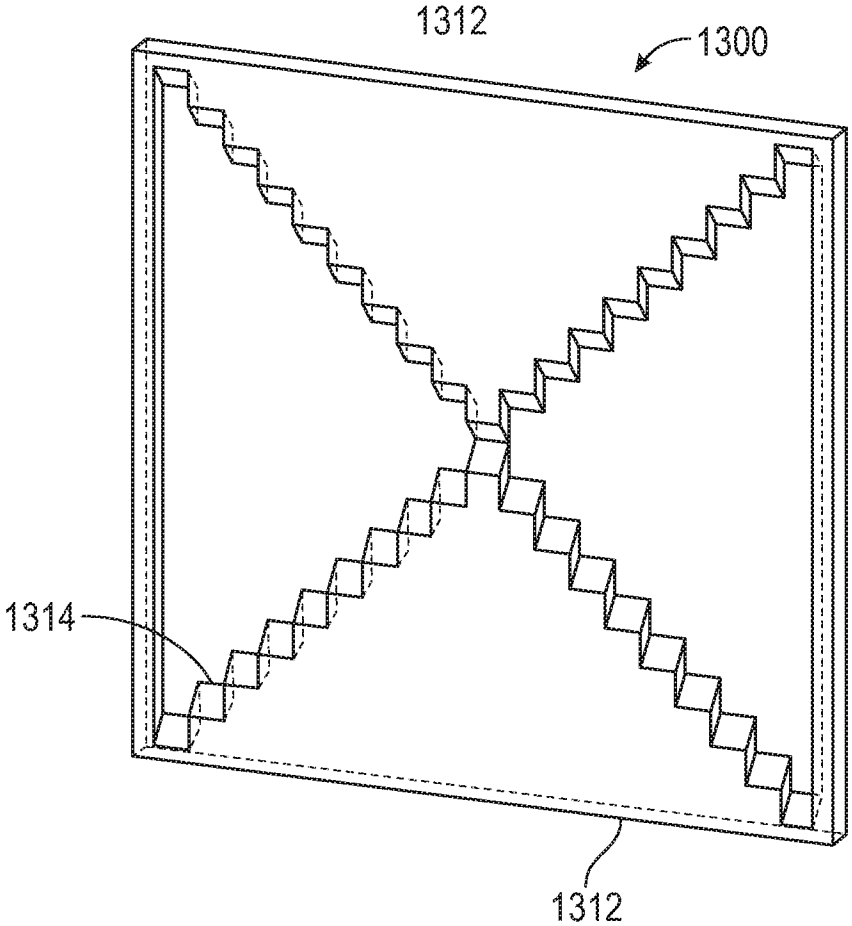
FIGS. 13A-D show an alternate embodiment of a target hit indicator, wherein the target hit indicator is integrally connected with the target.
Figure 13A:
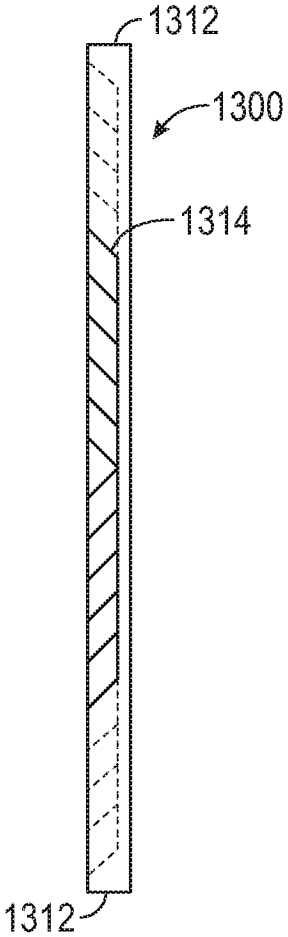
Figure 13D:
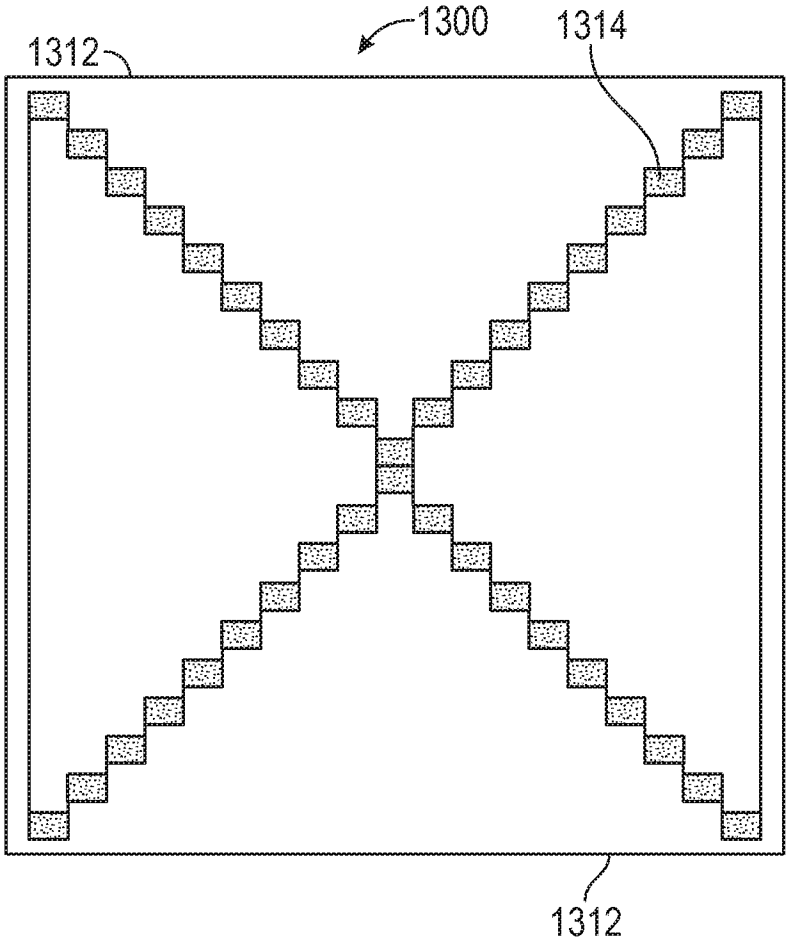
Figure 13C:
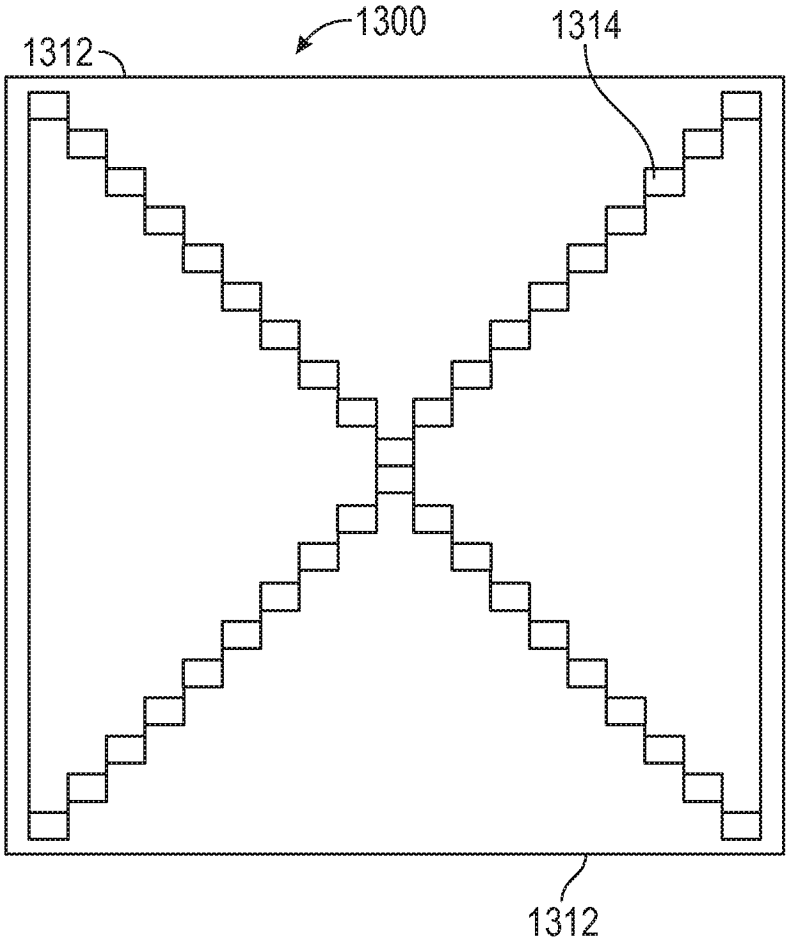

Rather than attaching to a steel target, a target hit indicator may be formed integrally with a target, as shown in FIGS. 13A-D. FIG. 13A is a side view of a target hit indicator formed integrally with a target while FIG. 13B is an oblique projection of the same. With reference to FIGS. 13A-D, target hit indicator target 1300 (hereinafter "THI target") may be made from a flexible transparent material which is designed to be impacted by a bullet. Material selection for the target is such that a bullet will pass through the THI target 1300 with minimal damage to the THI target 1300. Sensors (not shown) may detect whether the THI target 1300 has been impacted and may also detect the location of the impact. One or more light sources (not shown) along the top and bottom edges 1312 introduce light into the THI target 1300 which passes perpendicular to the thickness of THI target 1300 until the light reaches reflective surface element 1314. Reflective surface element 1314 reflects the light toward the shooter to indicate an impact (or miss) as shown by the arrows in FIGS. 13A and B. Thus, THI target 1300 acts similarly to the light redirection element of the other target hit indicator embodiments shown herein.

In the embodiment shown in FIG. 13, reflective surface elements 1314 form an "X" shape. FIG. 13C shows target 1300 with none of reflective elements 1314 illuminated, while FIG. 13D shows all elements illuminated. In operation, any one or more reflective surface elements 1314 may be illuminated to convey desired information. For example, specific elements may be illuminated to indicate the point of impact or the direction of a miss. Still further patterns could be used to indicate the number of hits or misses or even the battery condition.

Figure 14:
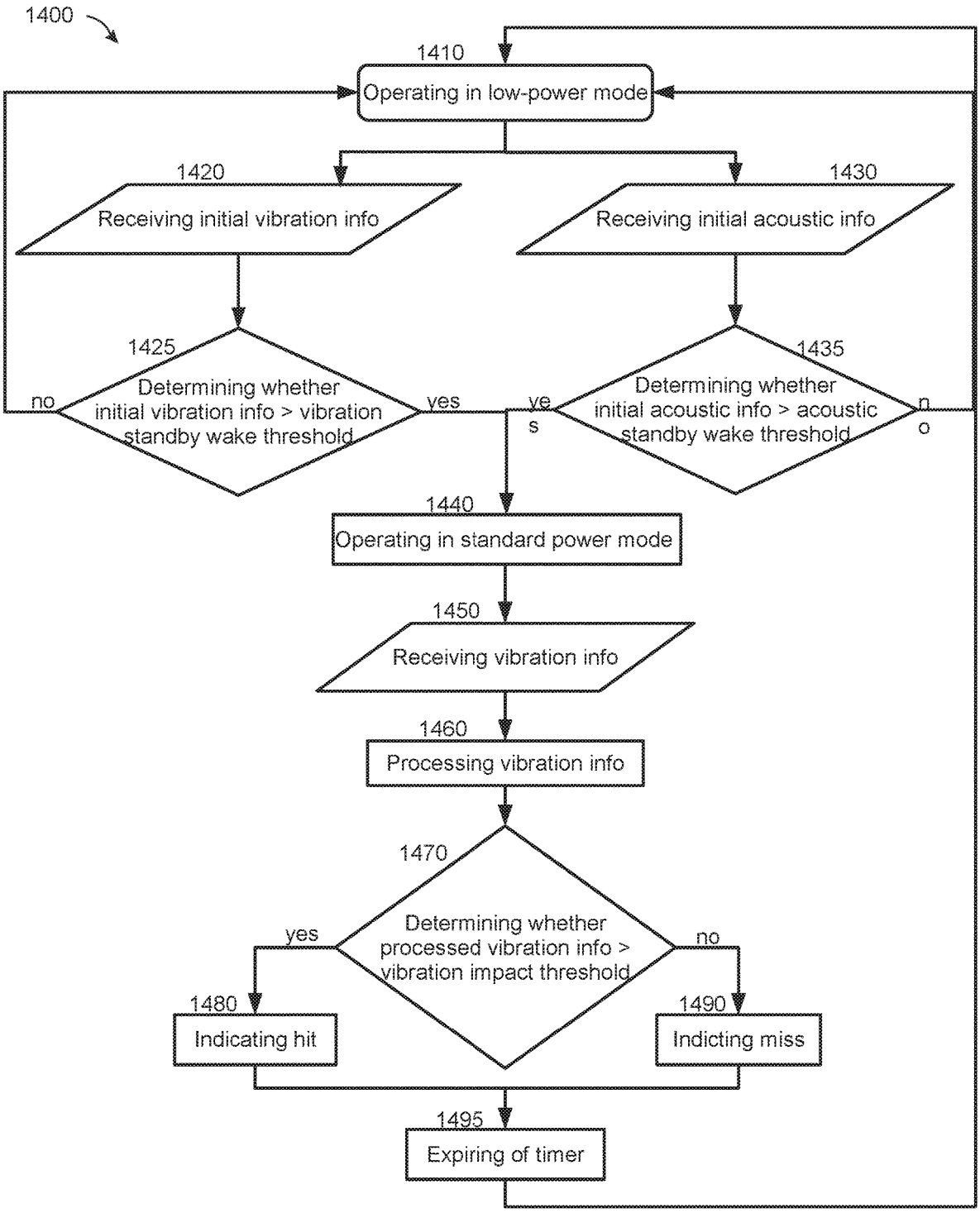
FIG. 14 depicts an exemplary embodiment of a method for operation of a target hit indicator.

FIG. 14 depicts an embodiment of a method 1400 of indicating whether a target has been impacted that may include operating 1410 a target hit indicator system in a low-power mode. While operating 1410 in low-power receiving 1420, from the impact sensor by the microcontroller unit, initial vibration information, and determining 1425 whether the initial vibration information is above a vibration standby wake threshold. Alternatively or in combination, method 1400 may include receiving 1430, from an acoustic sensor by the microcontroller unit, initial acoustic information, and determining 1435 whether the initial acoustic information is above an acoustic standby wake threshold. If either the initial vibration information is above the vibration standby wake threshold or the initial acoustic information is above the acoustic standby wake threshold waking the target hit indicator system, such that it is operating 1440 at standard power. Once the system has gone through the step of waking and is operating 1440 at standard power method 1400 may further include receiving 1450, from an impact sensor by a microcontroller unit, vibration information, processing 1460 the vibration information (e.g. by integration), determining 1470 whether the processed vibration information is above a vibration impact threshold, and if the processed vibration information is above a vibration impact threshold (a positive determination), indicating 1480 a hit via the impact indicator. The method 1400 may further include indicating 1490 a miss via the impact indicator if the processed vibration information is not above the vibration impact threshold (a negative determination).

The system may remain operating 1410 in a low-power mode responsive to its determining 1425 that the initial vibration information is less than the vibration standby wake threshold (a negative determination) and determining 1435 that the initial acoustic information is less than the acoustic standby wake threshold (a negative determination). The system may also revert back into operating 1410 in a low-power mode upon the expiring 1495 of a sufficient amount of time after determining 1425/1435 either of the standby wake thresholds have been surpassed and the system has indicated 1480/1490 either a hit or a miss.

Referring back to FIG. 7, in operation, MCU 710 may receive information from one or more of the impact sensor 750 and the acoustic sensor 760 and make a determination as to whether the target has been impacted. If it is determined 1470 that the target has been impacted (e.g., impact information is determined to be above a vibration impact threshold), MCU 710 may activate a light source 720, which may operate as an impact indicator, to signal an impact. In some embodiments, the target hit indicator may comprise an additional light source 730, which may output a different color light to operate as a miss indicator, to indicate that a projectile passed near the target hit indicator but did not impact the target. If MCU 710 determines 1470 that a miss occurred, light source 730 may be activated.

In some embodiments, the MCU 710 may be always powered on, while power to other components (e.g., impact sensor 750, acoustic sensor 760, dc/dc converter 740, etc.) may be selectively controlled and reduced when the MCU 710 determines that power to some components is unnecessary. The MCU 710 may be configured to manage the system such that components default to a low-power "standby" mode after a period of time in which no hits or misses are detected. In the low-power standby mode, some components (including a clock, which may be integrated into the MCU 710) may not be powered, so as to minimize the target hit indicator's power consumption and thereby increase its operational battery life.

In some embodiments, in a standby mode, the system may "listen" for impact information from the impact sensor 750 and acoustic information from the acoustic sensor 760. If impact information or acoustic information is received, the system may "wake up" from standby mode and resume an "active" mode in which power may be restored to more or all of the components under control of the MCU. In some embodiments, the MCU may receive an interrupt from the impact sensor 750 or acoustic sensor 760. In embodiments, the MCU may be configured to wake up one or more components of the system upon receiving impact information or acoustic information that exceeds an associated standby wake threshold.

In one embodiment, if the target hit indicator system is woken up by the acoustic sensor 760, the system may monitor only the acoustic sensor 760. If, after being awakened by acoustic sensor 760, vibration above a threshold (e.g. the vibration standby wake threshold) is detected by impact sensor 750, the system may ignore the acoustic information and monitor the impact sensor 750 only.

In embodiments as shown in FIGS. 7 and 14, when MCU 710 receives 1420 initial impact information from the impact sensor 750 that is determined 1425 to exceed a vibration standby wake threshold, MCU 710 may communicate with impact sensor 750 to receive 1450 additional impact information for some time interval (e.g., 100 milliseconds). MCU 710 may add, integrate, or otherwise process 1460 additional impact information to obtain a total amount of acceleration for the time interval. If the total amount of acceleration is determined 1470 to exceed a specified value (i.e. vibration impact threshold) during the time interval, the system may determine 1470 that the target has been impacted and indicate 1480 a hit via light source 720. If the total amount of acceleration is determined 1470 to not exceed the vibration impact wake threshold during the time period, the MCU 710 may determine 1470 that the target has not been impacted and may perform no action or may indicate 1490 a miss via light source 730.

In embodiments, the unitary target hit indicator may utilize a two-factor detection system. A two-factor detection system may combine acoustic and acceleration information to determine if target is struck and filter out non-hit events such as hitting support structure or kicked up rocks. In such embodiments, acoustic data and acceleration data may be combined to provide more accurate hit/miss determination. There are several methods in which a two-factor detection system may be used. In some embodiments, the target hit indicator may use a two-factor detection system that may require both acoustic information and acceleration-based impact information to count as a hit. This may reduce the number of false hits a user may experience and may prevent false indications of hits/misses while the user is mounting or handling a target hit indicator, especially if the target hit indicator is set to a very sensitive mode. In an alternate embodiment, the target hit indicator may utilize a two-factor detection system that may require that any acceleration "hit" be accompanied by the sound of about the frequency of the target being struck.

Some embodiments of the target hit indicator system may require that the relative time-of-arrival of the sound received by the acoustic sensor and the vibration of the target received by the impact sensor fall within a designated range in order to determine a hit.

In some embodiments, the vibration and/or acoustic standby wake thresholds or the vibration and/or acoustic impact thresholds may be set or modified by the user. For example, preset values may be selectable by a switch or a user may be able to program specific values into the target hit indicator. In some embodiments, the programing of the thresholds, or other programing information (e.g. resetting the target hit indicator when programmed to determine and indicate successive hits), may be achieved by the target hit indicator receiving audio signals from the user. Such audio signals may be encoded to provide the target hit indicator with particular programming instructions, which may be decoded and interpreted by the MCU via the acoustic sensor. One particular advantage of this acoustic method of programming, especially with regard to the resetting of target hit indicators, is that it may allow for the programming of multiple target hit indicator systems with a single signal. This could be useful in situations such as use on a multi-target course, where the entire course, consisting of multiple targets each equipped with a separate target hit indicator, may be reset (or otherwise programmed) via a single audio signal.

In embodiments a target hit indicator may include a receiver, such as an infrared receiver, for sending programming information to the target hit indicator, or otherwise controlling the target hit indicator (e.g. turning the system on/off, etc.).

In alternate embodiments, these thresholds may be set by a "learning" mode. In such learning mode embodiments a user may place the target hit indicator system into the learning mode (e.g. by the actuation of a switch or by the transmission of a specific acoustic signal to the device) after which the system may register the next set of impact and/or acoustic information received by the target hit indicator may be used as either a hit or miss baseline against which subsequent information is compared in order to make the hit/miss determination. This may allow for the target hit indicator system to tailor its sensor thresholds to the particular target to which it has been attached as targets of different sizes, shapes, thicknesses, and materials can produce significantly different acoustic signatures when impacted by a bullet.

The use of collimators and adjustable housing positions may result in increased battery life for the target hit indicator, among other advantages. In the case of a target hit indicator using total internal reflection to direct light, collimators allow more light to be reflected and correspondingly less light lost to the environment. Additionally, the narrower the beam of light from the target hit indicator to the viewer, the less intense the light source must be to be viewable at a given distance. The collimator may help collect light and direct the light into a narrow beam. Necessarily, a narrower beam of light also has a smaller field of view. Therefore, adjustable housing positions allow a narrow beam of light to reach an intended viewer and thus minimize the necessary intensity of the light source (and resulting power draw) of the target hit indicator.

In embodiments, the unitary design of the target hit indicator may provide environmental protection for the electronics while the low-power standby mode facilitates a very low power draw of the system that may extend battery life to months or even years, thus resulting in a target hit indicator that can be left on a target in uncontrolled weather for extended periods of time. These features provide for an advantage in that a user need not remove the target hit indicator after a shooting session, nor does the user need to travel to the target to turn the unit off. The target hit indicator may remain in a low-power standby mode for months or even years before the batteries are depleted.

Because portions of a target hit indicator may be sealed for protection against dust and the weather, controlling the target hit indicator may require means other than traditional switches and buttons. Controlling a target hit indicator may entail changing operating modes, flashing sequences, turning the unit on or off, etc. Embodiments of target hit indicators may be controlled using acoustic sounds received by the microphone. Embodiments may also be controlled through the use of sensors that detect magnetic fields, or radio frequency transmissions (including wi-fi, bluetooth, etc.). Control may also be achieved by holding the target hit indicator unit in a particular orientation or by tapping the unit a specified number of times. For example, a target hit indicator may be turned off and on by holding a unit roughly orthogonal to the orientation it would be on a target and tapping the unit quickly three times. Confirmation of a mode change can be relayed to the user, such as by flashing lights in a particular pattern.

In embodiments, a target hit indicator may be attached to a target using any suitable attachment structure now known or hereinafter discovered including, but not limited to, adhesives, straps, magnets, welding, brazing, soldering, fasteners including screws or bolts, and hook and loop type fasteners. Alternatively, rather than being separate from and mechanically attached to a target, a target hit indicator may be formed integrally with a target.

In embodiments, a light pipe may be a particular embodiment of a light redirection element. In alternate embodiments, rather than passing through a light pipe, light may pass through air or another suitably transparent medium until it contacts a light redirection element at which point the light may reflect off the light redirection element before continuing to the viewer. Such embodiments, for example, may be similar to the embodiment shown in FIG. 5A, except omitting the light pipe, with a light redirection element being included in a position coplanar with where light redirection element would have been. The light redirection element may be any of a number of materials or types of light redirection elements, such as a mirror, glass, polymer (e.g., acrylic), metal, biaxially-oriented polyethylene terephthalate, or any other element capable of redirecting incident light to a new direction, and may have any structural configuration that functions to redirect light from the impact indicator light sources.

Other embodiments of an impact indicator may include signaling subsystems other than light and light redirection elements for notifying a user of a hit or a miss. For example, the hit indicator and miss indicator may be include any device having capability to convey information to a user over a distance, such as a flag, colored object, or moving object. Furthermore, a hit indicator comprising a light source may not require a light redirection element. In embodiments, the light sources may be exposed around the edge of the target, and may be replaceable in the event of a bullet strike. In embodiments, for example, a hit indicator light source may be located on a movable arm which may extend or rotate from a retracted position behind a target to a visible position outside the edge of the target, thus placing it in view of a user. Such a movable arm may move from behind the target upon detection of an impact or miss and may retract after a period of time, allowing a user to take another shot yet still prevent damage to the hit indicator light source in the retracted position. Such a system may provide the additional advantage of having no portion of the target hit indicator light source exposed from behind the target, except during a brief period of time after the detection of a hit or a miss, in which it signals said hit or miss. This may reduce likelihood of damage to the hit indicator light source due to impact with a subsequently fired projectile.

In embodiments, patterns of light flashes or other indicator methods may be used to convey types of information other than a binary hit/miss indication. In one embodiment, for example, a count of the total number of hits or misses may be conveyed. In an embodiment, a low battery indication may be conveyed via the use of different colors of light, different numbers of flashes, etc.

Figure 15:
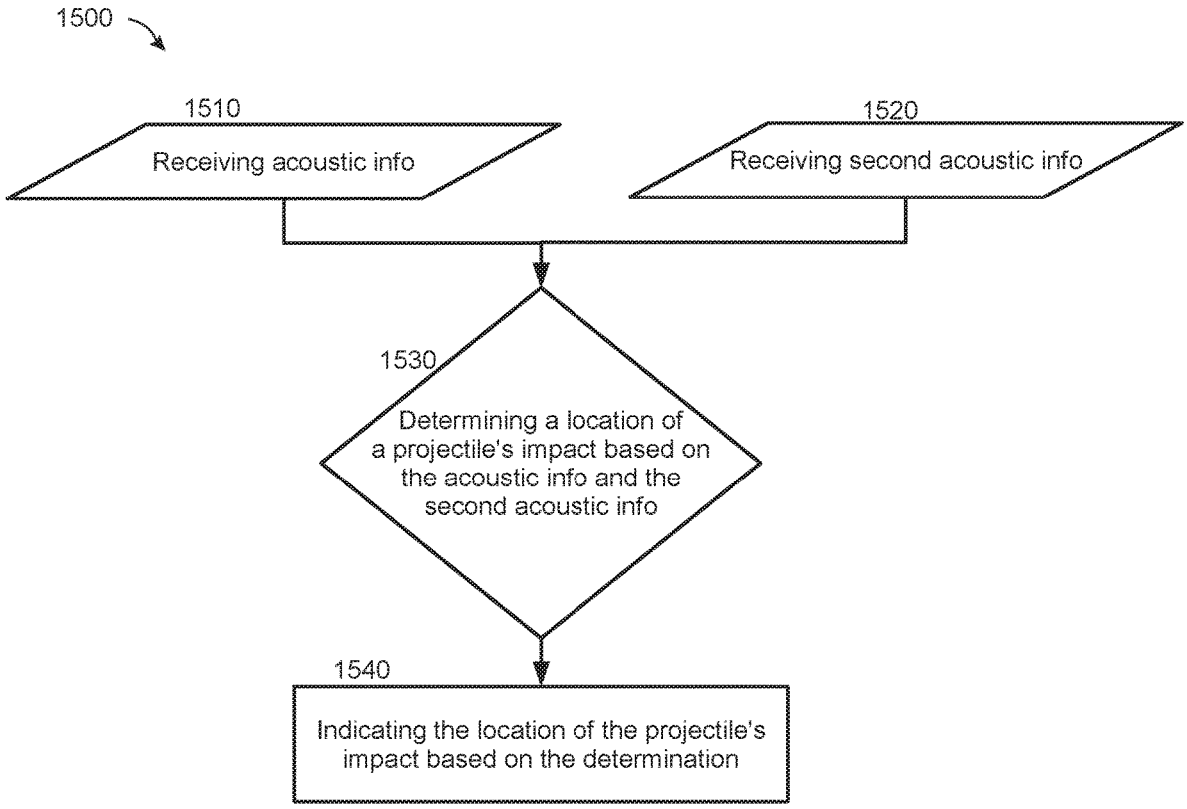
FIG. 15 depicts an exemplary embodiment of a method for identifying the impact location of a projectile using a plurality of sensors.

Embodiments of a target hit indicator may comprise a plurality of acoustic sensors spaced apart from each other in at least one axis. Such a configuration of a target hit indicator may provide for the capability of acoustically determining the location of an impact or miss. In such embodiments the target hit indicator may determine a horizontal location of a miss based on the order, time difference, or intensity between the sound being received at each acoustic sensor. The impact indicator may then use a signaling methodology to indicate the direction of the hit/miss to the user, for example, by flashing lights on one side only or by a sweeping motion. Any suitable number of impact sensors or acoustic sensors may be used to locate an impact or miss and different configurations of indicators may be used to indicate direction. With reference to FIG. 15, such embodiments may determine the location of an impact by a method such as method 1500, in which the target hit indicator is receiving 1510 acoustic info from a first acoustic sensor, and receiving 1520 second acoustic info from a second acoustic sensor, and uses the acoustic info and the second acoustic info to make a determining 1530 of where the projectile made impact. In embodiments, n number of acoustic sensors may be used to receive n number of sets of acoustic info to inform the determining 1530 of the projectile impact location. Method 1500 may further include indicating 1540 the location of the projectile's impact based on the determining 1530. Such an indicating 1530 may be achieved by, for example, activating lights on only the half of the target hit indicator corresponding to the location of the impact. Method 1500 may be most useful for indicating to the shooter to which side they missed the target.

One of ordinary skill in the art would recognize that many features disclosed herein may provide advantages over the prior art either alone or in combination with other features and therefore subject matter disclosed herein should not be taken as dependent on the inclusion of any other subject matter herein, unless expressly stated otherwise. For example, the use of integration or other processing of impact information to determine whether a projectile has impacted a target may be useful for unitary as well as non-unitary target hit indicators.

One or ordinary skill in the art will also recognize that many suitable materials may be used in constructing a target hit indicator, including metals, plastics or other polymers, glass, rubber, wood, etc. One would also recognize that material choice for a part is dependent on the desired properties of the part and that use of heavier materials may have additional advantages that outweigh the disadvantage of the increased weight. Further, one of ordinary skill in the art will also recognize that many variations of the systems and methods disclosed herein are possible without departing from the scope of embodiments.

What is claimed is:

1. A target hit indicator system, comprising:
a microcontroller;
an impact sensor; and
a flag actuation system;
wherein the microcontroller is configured to receive impact information from the impact sensor and activate the flag actuation system based on a determination that the impact information is above an impact threshold, and wherein the microcontroller is further configured to determine whether the impact information is above the impact threshold and to activate the flag actuation system based on the determination being negative.

2. The system of claim 1, the flag actuation system comprising:
a motor; and
a flag connected to the motor;
wherein the flag actuation system is configured to receive a signal from the microcontroller, and responsive to said signal, actuate the motor, such that the flag moves from a first position to a second position.

3. The system of claim 2, wherein actuation of the flag arm comprises rotation of the flag about an axis.

4. The system of claim 2, wherein actuation of the flag arm comprises translation of the flag along an axis.

5. The system of claim 2, wherein the flag comprises a color.

6. The system of claim 2, wherein the flag comprises a light source.

7. The system of claim 1, further comprising:
a second flag actuation system;
wherein the microcontroller is further configured to activate the second flag actuation system based on the determination being negative.

8. The system of claim 2, further comprising:
at least one additional flag; and
a flag selection system;
wherein, the microcontroller determines a selected flag out of the flag and the at least one additional flag; and
wherein the flag selection system is configured to reconfigure the relationship between the selected flag motor such that the selected flag, when moved via actuation of the motor becomes visible to a user.

9. The system of claim 2, further comprising a housing defining a volume; wherein the microcontroller, the impact sensor, and the motor are retained within the volume.

10. The system of claim 9, wherein at least a portion of the flag is outside of the volume at least when in the second position.

11. The system of claim 10, wherein the first position corresponds to a retracted configuration; and wherein the second position corresponds to an extended configuration.

12. The system of claim 8, wherein the selected flag determination is based on the impact determination.

13. The system of claim 8, wherein the flag and the at least one additional flag differ by at least one of the following:
color;
pattern;
shape;
size; and
brightness.

14. The system of claim 1, further comprising an acoustic sensor.

* * * * *